US012716414B2

(12) United States Patent
Afshari

(10) Patent No.: US 12,716,414 B2
(45) Date of Patent: Aug. 25, 2026

(54) DIAGNOSTIC CHECKS OF A GEAR PUMP IN A FLUID SYSTEM

(71) Applicant: Project Phoenix, LLC, Mesa, AZ (US)

(72) Inventor: Thomas Afshari, Phoenix, AZ (US)

(73) Assignee: Project Phoenix, LLC, Mesa, AZ (US)

( * ) Notice: Subject to any disclaimer, the term of this patent is extended or adjusted under 35 U.S.C. 154(b) by 0 days.

(21) Appl. No.: 18/716,864

(22) PCT Filed: Dec. 13, 2022

(86) PCT No.: PCT/US2022/052659

§ 371 (c)(1),
(2) Date: Jun. 5, 2024

(87) PCT Pub. No.: WO2023/114181

PCT Pub. Date: Jun. 22, 2023

(65) Prior Publication Data

US 2025/0035111 A1 Jan. 30, 2025

Related U.S. Application Data

(60) Provisional application No. 63/290,437, filed on Dec. 16, 2021.

(51) Int. Cl.
*F04C 2/08* (2006.01)
*F04C 14/28* (2006.01)

(52) U.S. Cl.
CPC ..... *F04C 2/084* (2013.01); *F04C 14/28* (2013.01); *F04C 2240/81* (2013.01); *F04C 2270/80* (2013.01)

(58) Field of Classification Search
CPC ..... F04C 2/084; F04C 14/28; F04C 2240/81; F04C 2270/80; F04C 2240/402; F04C 2/18; F04C 14/08
See application file for complete search history.

(56) References Cited

U.S. PATENT DOCUMENTS 337,551 A 3/1886 Berrenberg et al.
688,616 A 12/1901 Ferguson
(Continued)

FOREIGN PATENT DOCUMENTS

CA 2236535 A1 11/1999
CA 2878316 A1 3/2014
(Continued)

OTHER PUBLICATIONS

Esposito, Fluid Power with Applicators, 7th Ed., Chapter 5, pp. 154-162 (2009).
(Continued)

*Primary Examiner* — J. T. Newton
(74) *Attorney, Agent, or Firm* — Ashurst Perkins Coie US LLP

(57) ABSTRACT

A method of and system for self-check diagnostics. The system includes a pump control circuit that is configured for operating a first motor to rotate a first gear of a pump and a second motor to rotate a second gear of the pump. The pump control circuit also includes a sensor for determining a position and/or a velocity of the first gear. The system also including a diagnostic circuit that is configured to perform a diagnostic check to determine at least one of a gear wear parameter based on the sensor, a calibration drift of the sensor, or an obstruction in the pump using the sensor.

20 Claims, 6 Drawing Sheets

(56) References Cited

U.S. PATENT DOCUMENTS 1,341,846 A 6/1920 Gollings
1,361,423 A 12/1920 Waterous
1,407,496 A 2/1922 Storey
1,418,741 A 6/1922 Stallman
1,665,120 A 4/1928 Wendell
1,681,796 A 8/1928 Wendell
1,712,157 A 5/1929 Morita
2,439,427 A 4/1948 Guibert et al.
2,572,334 A 10/1951 Guibert
2,601,397 A 6/1952 Hill et al.
2,621,603 A 12/1952 Thomas
2,918,209 A 12/1959 Schueller
2,927,429 A 3/1960 Carlson
2,928,295 A 3/1960 Boulanger
2,937,807 A 5/1960 Lorenz
2,940,661 A 6/1960 Lorenz
3,136,224 A 6/1964 Escobosa
3,264,502 A 8/1966 Lytle et al.
3,585,973 A 6/1971 Klover
3,694,105 A 9/1972 Martin
3,763,746 A 10/1973 Walters
3,922,855 A 12/1975 Bridwell et al.
3,932,993 A 1/1976 Riedhammer
3,979,910 A 9/1976 Leuenberger et al.
4,016,719 A 4/1977 Yavnai
4,030,403 A 6/1977 Elser
4,328,450 A 5/1982 Gabor
4,345,436 A 8/1982 Johnson
4,369,625 A 1/1983 Izumi et al.
4,418,610 A 12/1983 Holtrop
4,529,362 A 7/1985 Ichiryu et al.
4,627,237 A 12/1986 Hutson
4,630,441 A 12/1986 Chamberlain
4,682,939 A 7/1987 Petro
4,696,163 A 9/1987 Glomeau
4,850,812 A 7/1989 Voight
5,026,248 A 6/1991 Hamilton
5,048,294 A 9/1991 Oshina et al.
5,073,091 A 12/1991 Burgess et al.
5,161,957 A 11/1992 Ribaudo
5,197,861 A 3/1993 Maruyama et al.
5,271,719 A 12/1993 Abe et al.
5,295,798 A 3/1994 Maruyama et al.
5,329,216 A 7/1994 Hasegawa
5,417,551 A 5/1995 Abe et al.
5,708,311 A 1/1998 Claar et al.
5,709,537 A 1/1998 Maruyama et al.
5,767,635 A 6/1998 Steffens et al.
5,767,638 A 6/1998 Wu et al.
5,778,671 A 7/1998 Bloomquist et al.
5,836,746 A 11/1998 Maruyama et al.
6,002,186 A 12/1999 Coutu et al.
6,004,119 A 12/1999 Yoshiaki et al.
6,042,095 A 3/2000 Kuchta
6,048,235 A 4/2000 Kai
6,053,717 A 4/2000 Dixon
6,155,790 A 12/2000 Pyötsiä et al.
6,247,906 B1 6/2001 Pijanowski
6,447,256 B2 9/2002 Bussard
6,447,266 B2 9/2002 Antaki et al.
6,543,223 B2 4/2003 Muschong et al.
6,652,249 B2 11/2003 Kenney et al.
6,796,120 B2 9/2004 Franchet et al.
6,971,463 B2 12/2005 Shore et al.
6,979,185 B2 12/2005 Kaempe
7,000,386 B1 2/2006 Morgan
7,051,526 B2 5/2006 Geiger
7,148,635 B1 12/2006 Piefer et al.
7,155,910 B2 1/2007 Last
7,191,593 B1 3/2007 Ho
7,232,292 B2 6/2007 Lopatinsky et al.
7,240,893 B2 7/2007 Komaba et al.
7,281,372 B2 10/2007 Sakai et al.
7,434,395 B2 10/2008 He
7,537,441 B2 5/2009 Iwasaki
7,870,727 B2 1/2011 Mueller et al.
7,927,079 B2 4/2011 Suzuki et al.
8,157,539 B2 4/2012 Hidaka et al.
8,167,589 B2 5/2012 Hidaka et al.
8,206,134 B2 6/2012 Moldovan et al.
8,448,432 B2 5/2013 Bresie
8,869,924 B2 10/2014 Kim
8,959,905 B2 2/2015 Baltes et al.
9,228,586 B2 * 1/2016 Afshari ..... F04C 2/08
9,234,532 B2 1/2016 Vanderlaan et al.
9,670,943 B2 6/2017 Gomm et al.
9,920,755 B2 3/2018 Afshari
10,072,676 B2 9/2018 Afshari
10,294,936 B2 5/2019 Afshari
10,465,721 B2 11/2019 Afshari
10,539,134 B2 1/2020 Afshari
10,544,810 B2 1/2020 Afshari
10,544,861 B2 1/2020 Afshari
10,598,176 B2 3/2020 Afshari
10,677,352 B2 6/2020 Afshari
10,738,799 B2 8/2020 Afshari
10,808,732 B2 10/2020 Afshari
10,865,788 B2 12/2020 Afshari
10,995,750 B2 5/2021 Afshari
11,054,026 B2 7/2021 Afshari
11,060,534 B2 7/2021 Afshari
11,085,440 B2 8/2021 Afshari
11,118,581 B2 9/2021 Afshari
11,242,851 B2 2/2022 Afshari
11,280,334 B2 3/2022 Afshari
11,408,442 B2 8/2022 Afshari
11,512,695 B2 11/2022 Afshari
11,607,170 B2 3/2023 Sivan et al.
11,624,362 B2 * 4/2023 Dawn ..... F04C 13/00 417/44.1
11,713,757 B2 8/2023 Afshari
11,846,283 B2 12/2023 Afshari
2001/0036415 A1 11/2001 Pijanowski
2002/0009368 A1 1/2002 Bussard
2003/0077183 A1 4/2003 Franchet et al.
2003/0091448 A1 5/2003 Prampolini
2003/0126981 A1 7/2003 Bridger et al.
2003/0151315 A1 8/2003 Choi et al.
2003/0225396 A1 12/2003 Cartledge et al.
2004/0060430 A1 4/2004 Brinkman
2004/0089234 A1 5/2004 Hagglund et al.
2004/0191103 A1 9/2004 Gotschhofer
2004/0213680 A1 10/2004 Suzuki et al.
2005/0022523 A1 2/2005 Nagai et al.
2005/0050965 A1 3/2005 Zaremba et al.
2005/0089414 A1 4/2005 Ohman
2005/0112012 A1 5/2005 Marheineie
2005/0144939 A1 7/2005 Mentink et al.
2005/0254970 A1 11/2005 Mayer et al.
2006/0001202 A1 1/2006 Bauman
2006/0039804 A1 2/2006 Jordan et al.
2006/0156713 A1 7/2006 Kadlicko
2007/0074511 A1 4/2007 Verkuilen
2007/0098576 A1 5/2007 Horng et al.
2007/0101711 A1 5/2007 Debus
2007/0157612 A1 7/2007 He
2007/0166168 A1 7/2007 Vigholm
2008/0010984 A1 1/2008 Arbel et al.
2008/0190104 A1 8/2008 Bresie
2009/0210120 A1 8/2009 Stein
2009/0266934 A1 10/2009 Makino
2009/0297370 A1 12/2009 Moldovan et al.
2010/0226806 A1 9/2010 Mellet et al.
2010/0247362 A1 9/2010 Koizumi
2010/0264885 A1 10/2010 Olsen et al.
2010/0322805 A1 12/2010 Aregger
2010/0322806 A1 * 12/2010 Aregger ..... F04C 15/0061 418/2
2011/0000203 A1 1/2011 Riedel et al.
2011/0017310 A1 1/2011 Eriksson
2011/0030364 A1 2/2011 Persson et al.
2011/0030505 A1 2/2011 Hoyle et al.
2011/0060467 A1 3/2011 Orschel et al.
2011/0089082 A1 4/2011 Snawerdt

(56) References Cited

U.S. PATENT DOCUMENTS

| | | | | |
|---|---|---|---|---|
| 2011/0135516 | A1 | 6/2011 | Oishi et al. | |
| 2011/0209471 | A1 | 9/2011 | Vanderlaan et al. | |
| 2011/0250082 | A1 | 10/2011 | Han et al. | |
| 2012/0141315 | A1 | 6/2012 | Seto et al. | |
| 2012/0173027 | A1 | 7/2012 | Cheng et al. | |
| 2012/0213657 | A1 | 8/2012 | Kimberlin et al. | |
| 2012/0233997 | A1 | 9/2012 | Andruch, III et al. | |
| 2012/0260641 | A1 | 10/2012 | Opdenboch | |
| 2012/0260642 | A1 | 10/2012 | Opdenboch | |
| 2012/0305603 | A1 | 12/2012 | Kwok et al. | |
| 2013/0074487 | A1 | 3/2013 | Herold et al. | |
| 2013/0091833 | A1 | 4/2013 | Zhan et al. | |
| 2013/0098015 | A1 | 4/2013 | Opdenbosh | |
| 2013/0098017 | A1 | 4/2013 | Knussman et al. | |
| 2013/0098464 | A1 | 4/2013 | Knussman | |
| 2013/0183185 | A1 | 7/2013 | Dirscheri | |
| 2013/0239558 | A1 | 9/2013 | Shirao | |
| 2013/0298542 | A1 | 11/2013 | Lowman et al. | |
| 2014/0105714 | A1 | 4/2014 | Kim | |
| 2014/0130487 | A1 | 5/2014 | Akiyama et al. | |
| 2014/0174549 | A1 | 6/2014 | Dybing | |
| 2014/0260233 | A1 | 9/2014 | Giovanardi | |
| 2014/0308103 | A1 | 10/2014 | Pike | |
| 2014/0308106 | A1 | 10/2014 | Beschorner | |
| 2014/0366519 | A1 | 12/2014 | Sadamori | |
| 2015/0121860 | A1 | 5/2015 | Hyon | |
| 2015/0275927 | A1 | 10/2015 | Gomm et al. | |
| 2015/0308463 | A1 | 10/2015 | Gomm et al. | |
| 2015/0361743 | A1 | 12/2015 | Mikkulainen | |
| 2016/0102685 | A1 | 4/2016 | Chester | |
| 2016/0201694 | A1 | 7/2016 | Vacca et al. | |
| 2018/0252213 | A1* | 9/2018 | Afshari | F04B 49/22 |
| 2018/0266415 | A1* | 9/2018 | Afshari | F15B 15/18 |
| 2018/0291895 | A1* | 10/2018 | Afshari | F04C 14/08 |
| 2019/0063431 | A1 | 2/2019 | Kawaga | |
| 2020/0347854 | A1 | 11/2020 | Afshari | |
| 2021/0215157 | A1* | 7/2021 | Dawn | F04C 2/00 |
| 2021/0285442 | A1 | 9/2021 | Kamada et al. | |
| 2021/0317829 | A1* | 10/2021 | Afshari | F04C 15/0092 |
| 2022/0049696 | A1 | 2/2022 | Jang et al. | |
| 2022/0128006 | A1 | 4/2022 | Shimamura et al. | |
| 2022/0163054 | A1 | 5/2022 | Afshari | |
| 2023/0250820 | A1 | 8/2023 | Afshari | |
| 2023/0279856 | A1* | 9/2023 | Afshari | F04C 2/10 417/410.4 |
| 2023/0313795 | A1 | 10/2023 | Afshari | |

FOREIGN PATENT DOCUMENTS

| | | | |
|---|---|---|---|
| CH | 625600 | A5 | 9/1981 |
| CN | 101994690 | 1 | 3/2011 |
| CN | 202165337 | U | 3/2012 |
| CN | 101655087 | A | 2/2018 |
| CN | 109779985 | A | 5/2019 |
| DE | 1258617 | | 1/1968 |
| DE | 1528965 | | 10/1969 |
| DE | 3230550 | A1 | 1/1984 |
| DE | 3247004 | A1 | 6/1984 |
| DE | 3821321 | A1 | 12/1989 |
| DE | 102008018407 | A1 | 10/2009 |
| DE | 102009027282 | A1 | 12/2010 |
| DE | 102009028095 | A1 | 2/2011 |
| DE | 102009045028 | A1 | 3/2011 |
| DE | 102011005831 | A1 | 9/2012 |
| DE | 102012102156 | A1 | 10/2012 |
| DE | 102011076127 | A1 | 11/2012 |
| EP | 0558921 | A1 | 9/1993 |
| EP | 0942173 | A1 | 9/1999 |
| EP | 1249608 | A1 | 10/2002 |
| EP | 1531269 | A1 | 5/2005 |
| EP | 1967745 | A1 | 9/2008 |
| EP | 2113666 | A2 | 11/2009 |
| EP | 2767720 | A1 | 8/2014 |
| EP | 2816237 | A1 | 12/2014 |
| EP | 2275684 | A1 | 1/2019 |
| FR | 2119294 | A5 | 8/1972 |
| FR | 2428771 | A1 | 1/1980 |
| GB | 270000 | A | 5/1927 |
| GB | 1081711 | A | 8/1967 |
| GB | 1284551 | A | 8/1972 |
| GB | 1284552 | A | 8/1972 |
| GB | 1284553 | A | 8/1972 |
| GB | 1450436 | A | 9/1976 |
| GB | 2123089 | A | 1/1984 |
| GB | 2259333 | A | 3/1993 |
| JP | S5920590 | A | 2/1984 |
| JP | H11166496 | A | 6/1999 |
| JP | H11336671 | A | 12/1999 |
| JP | 2001011899 | A | 1/2001 |
| JP | 2001153066 | A | 6/2001 |
| JP | 2002147370 | A | 6/2002 |
| JP | 2003088084 | A | 3/2003 |
| JP | 2003106304 | A | 4/2003 |
| JP | 2006316662 | A | 11/2006 |
| JP | 3154210 | U | 10/2009 |
| JP | 2010038316 | A | 2/2010 |
| JP | 2014009655 | A | 1/2014 |
| JP | 2014512495 | A | 5/2014 |
| RU | 2284424 | C1 | 9/2006 |
| RU | 2009149035 | A | 8/2011 |
| SU | 857550 | A1 | 8/1981 |
| SU | 1087705 | A1 | 4/1984 |
| WO | WO9113256 | A1 | 9/1991 |
| WO | WO01073295 | A1 | 10/2001 |
| WO | WO03069160 | A1 | 8/2003 |
| WO | WO2004071845 | A1 | 8/2004 |
| WO | WO2008060681 | A2 | 5/2008 |
| WO | WO2010083991 | A2 | 7/2010 |
| WO | WO2010097596 | A1 | 9/2010 |
| WO | WO2011035971 | A2 | 3/2011 |
| WO | WO2011048261 | A1 | 4/2011 |
| WO | WO2011072502 | A1 | 6/2011 |
| WO | WO2012122159 | A2 | 9/2012 |
| WO | WO2013006902 | A1 | 1/2013 |
| WO | WO2013027620 | A1 | 2/2013 |
| WO | WO2014060760 | A2 | 4/2014 |
| WO | WO2014074713 | A1 | 5/2014 |
| WO | WO2014135284 | A1 | 9/2014 |
| WO | WO2014176256 | A1 | 10/2014 |
| WO | WO2017040825 | A1 | 3/2017 |
| WO | WO2018206050 | A1 | 11/2018 |

OTHER PUBLICATIONS

Marks' Standard Handbook for Mechanical Engineers, Eighth Ed., Section 14, pp. 14-1-14-31 (1978).

Yusof et al., "Slip flow coefficient analysis in water hydraulics gear pump for environmental friendly application," IOP Conf. Series: Materials Science and Engineering, 50:012016 (2013).

International Search Report and Written Opinion, International Application No. PCT/US2015/018342 (published as WO 2015/131196), 19 pages (Jul. 20, 2015).

International Search Report and Written Opinion, International Application No. PCT/US2015/022484, (published as WO 2015/148662), 9 pages (Jun. 9, 2015).

International Search Report and Written Opinion, International Application No. PCT/US2015/027003 (published as WO 2015/164453), 18 pages (Nov. 4, 2015).

International Search Report and Written Opinion, International Application No. PCT/US2015/033752 (published as WO 2015/187673), 15 pages (Sep. 29, 2015).

International Search Report and Written Opinion, International Application No. PCT/US2015/033764 (published as WO 2015/187681), 7 pages (Aug. 19, 2015).

International Search Report and Written Opinion, International Application No. PCT/US2015/033776 (published as WO 2015/187688), 31 pages (Oct. 28, 2015).

International Search Report and Written Opinion, International Application No. PCT/US2015/041612 (published as WO 2016/014715), 8 pages (Sep. 28, 2015).

(56) References Cited

OTHER PUBLICATIONS

International Search Report and Written Opinion, International Application No. PCT/US2015/053670 (published as WO 2015/057321), 10 pages (Dec. 16, 2015).
International Search Report and Written Opinion, International Application No. PCT/US2015/054145 (published as WO 2016/064569), 9 pages (Feb. 2, 2016).
International Search Report and Written Opinion, International Application No. PCT/US2015/050589 (published as WO 2016/048773), 10 pages (Dec. 7, 2015).
International Search Report and Written Opinion, International Application No. PCT/US2016/049918 (published as WO 2017/040792), 10 pages (Nov. 23, 2016).
International Search Report and Written Opinion, International Application No. PCT/US2016/049959 (published as WO 2017/040825), 10 pages (Dec. 9, 2016).
International Search Report and Written Opinion, International Application No. PCT/US2021/040686, (Oct. 10, 2021), 13 pages.
International Search Report and Written Opinion of International Application No. PCT/US2021/040701, (Oct. 27, 2021) 12 pages.
International Search Report and Written Opinion of International Application No. PCT/US2022/052659, (Mar. 16, 2023) 13 pages.
Supplementary European Search Report, EP Application No. 15803994.1, 7 pages (Jan. 22, 2018).
Supplementary European Search Report, EP Application No. 15802457.0, 24 pages (Mar. 14, 2018).
Supplemental European Search Report, EP Application No. 18207568.9, 7 pages (Feb. 4, 2019).
Supplemental European Search Report, EP Application No. 15803186.4, 9 pages (Dec. 17, 2019).
Examination Report, EP Application No. 15709812.0, 5 pages (Jun. 17, 2019).
Supplementary European Search Report, EP Application No. 20166746.6, 7 pages (May 6, 2020).
Supplementary European Search Report, EP Application No. 20168937.9, 8 pages (May 14, 2020).
Supplementary European Search Report, EP Application No. 20179980.6, 8 pages (Jul. 30, 2020).
Extended European Search Report, EP Application No. 20197360.9, 8 pages (Nov. 10, 2020).
Extended European Search Report, EP Application No. 201168887.4, 10 pages (May 21, 2021).
Examination Report for EP Application No. 20179980.6; 4 pages (May 26, 2021).
Examination European Search Report, EP Application No. 157219434.7; 4 pages (Aug. 30, 2021).
Extended European Search Report, EP Application No. 21175762.0; 7 pages (Sep. 17, 2021).
Extended European Search Report, EP Applciation No. 21201681.0; 8 pages (Jan. 24, 2022).
Extended European Search Report, EP Application No. 21203155.3; 8 pages (Feb. 23, 2022).
Examination Report for EP Application No. 15715589.6; 4 pages (Jun. 13, 2022).
Extended European Search Report, EP Application No. 22162029.7; 8 pages (Jul. 5, 2022).
Examination Report for EP Application No. 15784832.6, 7 pages (Jul. 5, 2022).
Examination Report for EP Application No. 20197360.9, 8 pages (Nov. 28, 2022).
Extended European Search Report for EP Application No. 22202305.3; 7 pages (Jan. 25, 2023).
Examination Report Search Report for EP Application No. 21151341.1; 5 pages (Mar. 10, 2023).
Examination Report for EP Application No. 15784832.6; 6 pages (Dec. 21, 2023).
Examination Report for EP Application No. 21201681.0; 4 pages (Mar. 13, 2024).
Examination Report for EP Application No. 21168887.4; 4 pages (Mar. 19, 2024).
Examination Report for EP Application No. 21748749.5; 5 pages (Feb. 2, 2025).
Extended European Search Report for EP Application No. 22908306.8; 22 pages (Oct. 28, 2025).
Extended European Search Report for EP Application 25193788.4; 7 pages (Oct. 28, 2025).

* cited by examiner

DIAGNOSTIC CHECKS OF A GEAR PUMP IN A FLUID SYSTEM

CROSS-REFERENCE TO RELATED APPLICATION(S)

This application is a 371 National Stage application of International Application No. PCT/2022/052659, filed Dec. 13, 2022, which claims the benefit of U.S. Application No. 63/290,437, filed Dec. 16, 2021, the contents of which are referenced herein in their entirety.

TECHNICAL FIELD

This application is directed to a control system for a fluid pump that performs diagnostic checks of a pump in a fluid system and, more particularly, diagnostic checks of a gear pump in a fluid system.

BACKGROUND OF THE INVENTION

Gear pumps are typically used in industrial fluid pumping systems such as, for example, hydraulics systems for industrial equipment, aeronautics, etc. The gear pumps in these systems are generally have a driver-driven configuration in which one gear (driver gear) is coupled to a motor and the driver gear meshes with and drives another gear (driven gear) to transfer fluid from an inlet of the pump to an outlet of the pump. However, recent developments in gear pump designs have led to the introduction of drive-drive systems in which both gears are being driven at a precise angular velocity by respective motors. In these drive-drive systems, contact between meshing gear teeth pairs can be maintained by attempting to drive one gear "slightly faster" than the other (e.g., the speed demand to one of the motors is greater than the other). Of course, both gears rotate at the same speed, but by attempting to drive one gear faster, a contact force to seal backflow can be maintained between the meshing gear teeth pairs. Applicant's U.S. Pat. No. 9,228,586, which is incorporated herein by reference in its entirety as background, discloses an exemplary embodiment of a drive-drive gear pump. The control system can use high resolution position sensors (e.g., high-resolution encoders) mounted on the motor, gear and/or the coupling shaft to precisely control the position and/or angular velocity of the gears. Because one of the gears is not driving the other as in a driver-driven system, there can be less wear on the gear teeth in drive-drive systems for similar applications.

However, even in drive-drive systems, the gears will eventually wear and will need replacement. In addition, the gear tooth clearances in drive-drive gear pumps can be tighter than driver-driven gear pumps. Because the clearances are tighter, the drive-drive pump configuration is susceptible to foreign particles contaminating the fluid, which can cause issues with pump operation and/or promote excessive gear wear. While periodic manual inspections of the pump, including gear teeth, can be performed in related art systems, the related art systems do not have a method in which automatic checks for gear wear, calibration drift and/or obstructions are performed by the control system.

SUMMARY OF THE INVENTION

Preferred embodiments of the disclosure are directed to a pump control system with self-check diagnostics. The pump system can include a pump control circuit that can operate a first motor to rotate a first gear of a pump and a second motor to rotate a second gear of the pump. The pump control circuit can include a sensor for determining a position and/or a velocity of the first gear. The pump control system can include a diagnostic circuit connected to the pump control circuit. The diagnostic circuit can perform a diagnostic check to determine a gear wear parameter based on the sensor, a calibration drift of the sensor, and/or an obstruction in the pump using the sensor. In one embodiment, the diagnostic circuit is configured to control the pump control circuit to position a first tooth on the first gear so as to contact a second tooth on the second gear at a first point and read first position information of the first tooth from the sensor with the first tooth contacting the first point. The diagnostic circuit can also be configured to control the pump control circuit to position the first tooth on the first gear so as to contact a third tooth on the second gear at a second point and read second position information of the first tooth from the sensor with the first tooth contacting the second point. The diagnostic circuit can further be configured to determine, based on the first and second position information, the gear wear parameter, where the gear wear parameter can be a tooth width of the first tooth, a root width between the second tooth and third tooth, wear of the first tooth, and/or a wear rate of the first tooth.

In some embodiments, the diagnostic circuit of the pump control system can be configured to perform a calibration drift check. The calibration drift check can include reading first position information of the first gear from a first sensor when the first tooth is at a first reference point and reading second position information of the first gear from a second sensor when the first tooth is at the first reference point. The calibration drift check can then include determining a calibration drift based on a difference between the first and second position information, and based on the calibration drift, the diagnostic circuit can determine at least one of whether a recalibration is needed on the first or second sensors or whether a sensor fault exists on the first or second sensors.

In some embodiments, the diagnostic circuit of the pump control system can be configured to perform an obstruction and/or a contaminate check. The diagnostic circuit can operate the pump at a predetermined speed based on the sensor and monitor feedback that includes at least one of a gear feedback or a motor feedback. The diagnostic circuit can compare the monitored feedback to an expected feedback value for the predetermined speed and based on the comparison, determine whether there in an obstruction and/or contaminate in the pump based on a deviation between the monitored feedback and the expected feedback value.

In some embodiments, a pump control system that includes a pump control circuit that is configured to independently operate a first motor for rotating a first gear of a pump and a second motor for rotating a second gear of the pump. The pump control system including a diagnostic circuit connected to the pump control circuit. The diagnostic circuit is configured to position a first tooth on the first gear so as to contact a second tooth on the second gear at a first point and read first position information of the first tooth with the first tooth contacting the first point. In addition, the diagnostic circuit is configured to position the first tooth on the first gear so as to contact a third tooth on the second gear at a second point and read second position information of the first tooth with the first tooth contacting the second point. The diagnostic circuit is configured to determine at least one of a tooth width of the first tooth, root width between the second tooth and third tooth, wear of the first tooth, or a wear rate of the first tooth.

Another embodiment includes a method of performing a diagnostic check on a pump. The method includes operating a first motor to rotate a first gear of a pump and operating a second motor to rotate a second gear of the pump. The method further includes determining a position and/or a velocity of the first gear and performing a diagnostic check to determine at least one of a gear wear parameter based on the sensor, a calibration drift of the sensor, or an obstruction in the pump using the sensor. In some embodiments, the performing of the diagnostic check includes controlling a position of a first tooth on a first gear of the pump so as to contact a second tooth on a second gear of the pump at a first point. The diagnostic check method can further include reading, using the sensor, first position information of the first tooth with the first tooth contacting the first point and controlling the position of the first tooth so as to contact a third tooth on the second gear at a second point. The diagnostic check method can also include reading, using the sensor, second position information of the first tooth with the first tooth contacting the second point and determining, based on the first and second position information, the gear wear parameter, where the gear wear parameter includes at least one of a tooth width of the first tooth, root width between the second tooth and third tooth, wear of the first tooth, or a wear rate of the first tooth.

In some embodiments, the diagnostic check method can further include determining a second position and/or a second velocity of the first gear using a second sensor and reading first position information of the first gear from the first sensor when the first tooth is at a first reference point. The diagnostic check method can also include reading second position information of the first gear from the second sensor when the first tooth is at the first reference point and determining the calibration drift based on a difference between the first and second position information. The diagnostic check method can include, based on the calibration drift, determining whether a recalibration is needed on the first sensor or the second sensor or whether a sensor fault exists on the first sensor or the second sensor.

In some embodiments, the diagnostic check method can further include operating the pump at a predetermined speed based on the sensor and monitoring feedback that includes at least one of a gear feedback or a motor feedback. The diagnostic check method can further include comparing the monitored feedback to an expected feedback value for the predetermined speed and based on the comparison, determining whether there in an obstruction and/or contaminate in the pump based on a deviation between the monitored feedback and the expected feedback value.

The summary of the invention is provided as a general introduction to some embodiments of the invention and is not intended to be limiting to any particular drive-drive configuration or drive-drive-type system. It is to be understood that various features and configurations of features described in the Summary can be combined in any suitable way to form any number of embodiments of the invention. Some additional example embodiments including variations and alternative configurations are provided herein.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the exemplary embodiments of the invention.

DETAILED DESCRIPTION OF THE PREFERRED EMBODIMENTS

Exemplary embodiments of the invention are directed to a control system for a fluid pump in a drive-drive configuration. The control system performs diagnostic checks, which can be performed prior to operation and/or during operation of the fluid pump. Preferably, the fluid pump is a gear pump that includes two gears for transferring the fluid and each gear is driven by a respective motor. For example, the fluid pump can be an external gear pump or an internal gear pump.

Figure 1:
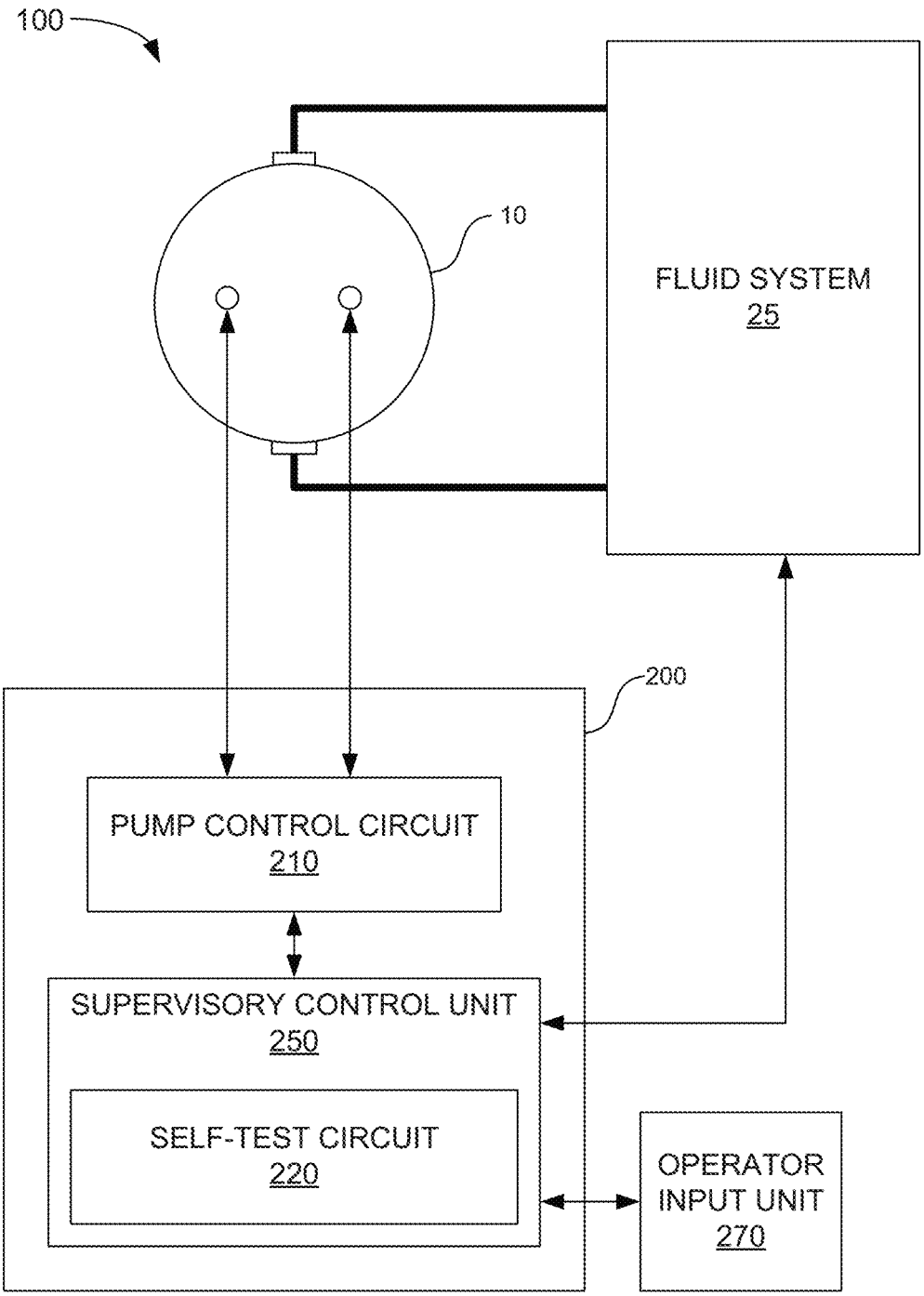
FIG. 1 is a block diagram of fluid pump system with a preferred embodiment of a pump assembly and control system.

FIG. 1 shows an exemplary block diagram of a pumping system 100 that includes a pump assembly 10 connected to a fluid system 25. The fluid system 25 can be any type of fluid system such as, for example, an industrial hydraulic system (e.g., linear actuator system, a hydrostatic transmission system, etc.), a water distribution system, and/or another type of fluid system. The pumping system 100 can include a pump control system 200 for controlling the operation of the pump assembly 10. Preferably, the pump control system 200 includes a pump control circuit 210 that controls pump assembly 10 and a supervisory control unit 250 that controls the overall operation of the fluid system 25 (e.g., control valves, shutoff valves, and/or lock valves, other pumps, etc.). The supervisory control unit 250 can include an operator input unit 270 to receive commands from a user. The operator input unit 270 can be, for example, a man-machine interface (e.g., keyboard, monitor, mouse, joystick, and/or another user interface). In some embodiments, the supervisory control unit 250 (and/or another controller) can include a self-test diagnostic control circuit 220 (also referred to herein as "self-test circuit 220") that can include the control logic (e.g., hardware, software, algorithms, etc.) for performing diagnostic checks on, for example, pump assembly 10. In some embodiments, the diagnostic checks can be performed before, during, and/or after normal operation of the pump assembly 10. The diagnostic checks can be initiated manually, periodically (e.g., based on operating hours and/or number of starts, etc.), before the pump is started (e.g., every time the pump is started, every $n^{th}$ time the pump is started—where n is an integer greater than 0, randomly, etc.), after the pump is stopped (e.g., every time the pump is stopped, every $n^{th}$ time the pump is stopped—where n is an integer greater than 0, randomly, etc.), based on process conditions (e.g., temperature, pressure, etc.), electrical conditions (e.g., pump and/or system power, torque, voltage, current, etc.), randomly, and/or some other criteria. In some embodiments, the self-test circuit 220 communicates with pump control circuit 210 to perform the diagnostic checks. The pump control circuit 210 can include hardware and/or software that interpret parameter feedback signals (e.g., signals related to system pressures, flows, temperatures, gear positions, gear velocities, motor currents and/or voltage, and/or some other measured parameter) and/or command signals from the supervisory control unit 250 and/or the user via input unit 270 (e.g., signals related to diagnostic checks, flow and/or pressure setpoints and/or some other command signal) and output the appropriate demand signals (e.g., speed, torque, and/or position demand signals and/or some other demand signal) to the pump assembly 10.

Figure 2:
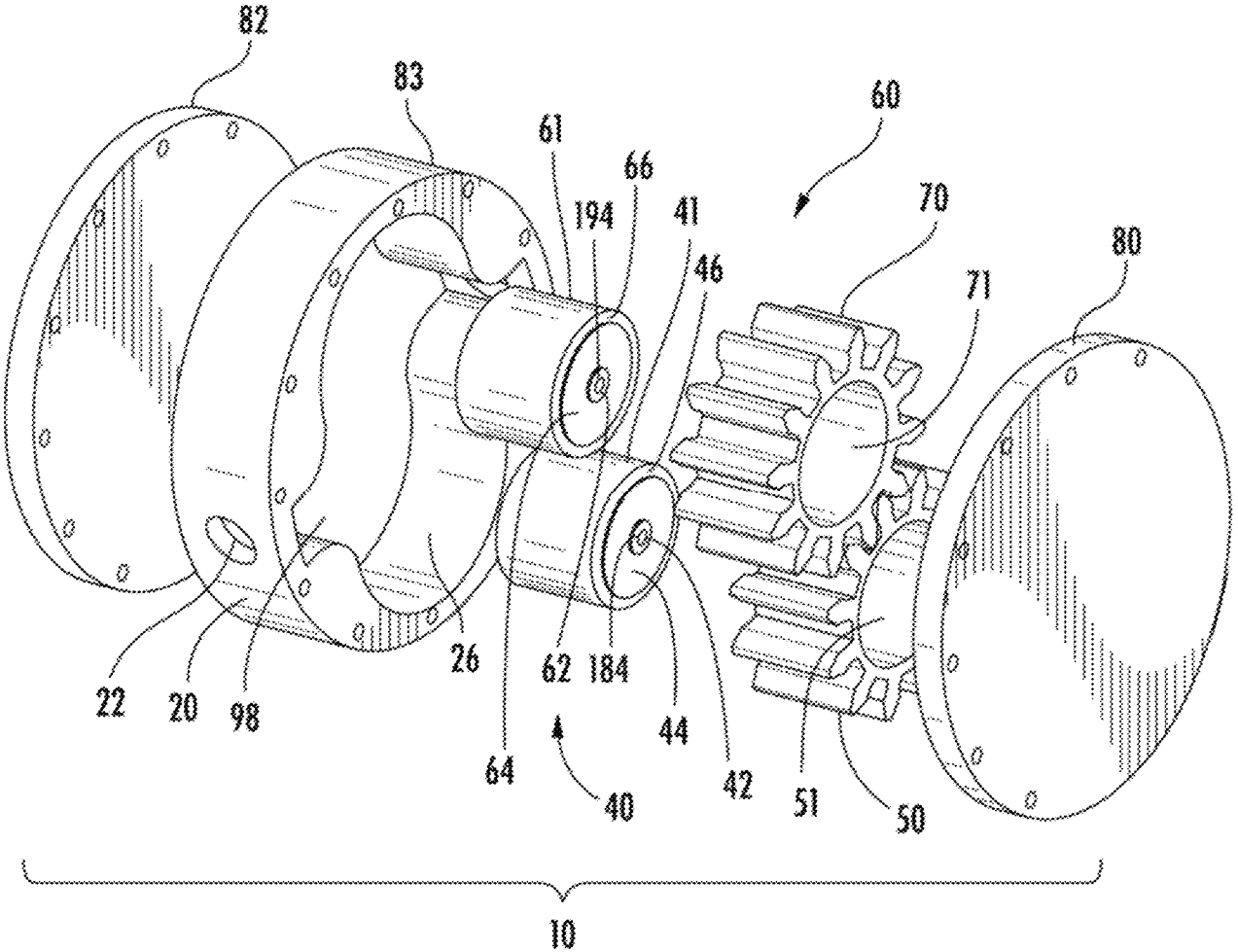
FIG. 2 shows an exploded view of an exemplary embodiment of a pump assembly having an external gear pump.
Figure 3:
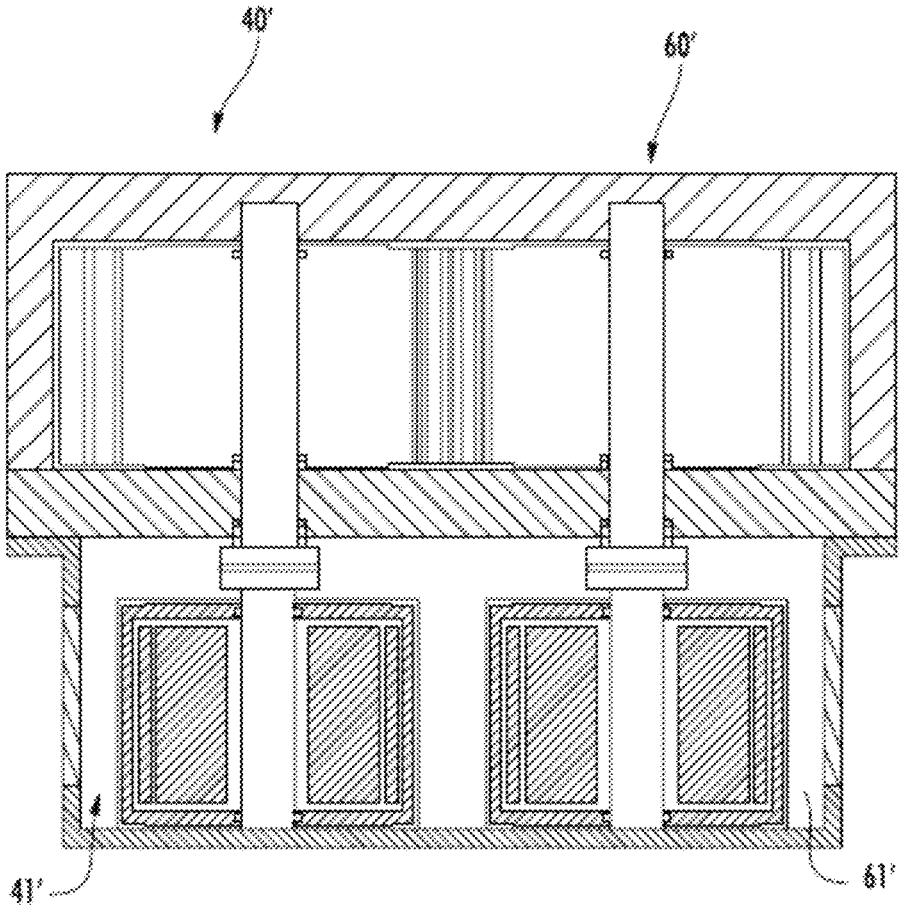
FIG. 3 shows a cross-sectional view of another exemplary embodiment of a pump assembly with a drive-drive configuration and having the motors disposed on the outside of pump interior.

FIG. 2 shows an exploded view of an exemplary embodiment of a pump assembly 10 (also referred to herein as "pump 10"). The pump 10 can include fluid drivers 40 and 60. The configuration and operation of pump 10 can be found in Applicant's U.S. Pat. Nos. 9,228,586 and 10,294,936, which are incorporated herein by reference in their entirety. Thus, for brevity, a detailed description of the configuration and operation of pump 10 is omitted except as necessary to describe the present exemplary embodiments. The fluid drivers 40, 60 respectively include a prime mover and a fluid displacement member. In the illustrated exemplary embodiment of FIG. 2, the prime movers are electric motors 41, 61 and the fluid displacement members are spur gears 50, 70. In this embodiment, both pump motors 41, 61 are disposed inside the openings 51, 71 (e.g., cylindrical openings) of gears 50, 70 when assembled. However, exemplary embodiments of the present disclosure cover other motor/gear configurations. For example, FIG. 3 illustrates a cross-sectional view of an embodiment of a pump assembly with the motors 41', 61' of fluid drivers 40' and 60' are disposed on the outside of pump interior. Other exemplary pump configurations can be found in U.S. Pat. Nos. 9,228,586 and 10,294,936.

As seen in FIG. 2, the pump assembly 10 represents a positive-displacement (or fixed displacement) gear pump. The pair of gears 50, 70 are disposed in the interior volume 98. Each of the gears 50, 70 has a plurality of gear teeth 52, 72 extending radially outward from the respective gear bodies. The gear teeth 52, 72, when rotated by, e.g., electric motors 41, 61, transfer fluid from the inlet to the outlet. The pump assembly 10 can be a variable speed and/or a variable torque pump (e.g., motors 41, 61 can be variable speed and/or variable torque motors) and thus rotation of the gears 50, 70 can be varied to create various volume flows and pump pressures. In some embodiments, the pump assembly 10 is bi-directional (e.g., motors 41, 61 can be bi-directional). In such embodiments, either port 22, 24 can be the inlet port and the other port will be the outlet port, depending on the direction of rotation of gears 50, 70.

The fluid drivers 40, 60 are disposed in an interior volume 98 that is defined by the inner wall of pump casing 20. The shafts 42, 62 of the fluid drivers 40, 60 are disposed between the port 22 and the port 24 of the pump casing 20 and are supported by the plate 80 at one end 84 and the plate 82 at the other end 86. The stators 44, 64 of motors 41, 61 are disposed radially between the respective shafts 42, 62 and the rotors 46, 66. The stators 44, 64 are fixedly connected to the respective shafts 42, 62, which are fixedly connected to the plates 82, 84 of casing 20. The rotors 46, 66 are preferably be connected to the stationary shafts 44, 64 via bearings (not shown). The rotors 46, 66 are disposed radially outward of the stators 44, 64 and surround the respective stators 44, 64. In some embodiments, the motors 41, 61 include casings (see elements 48 and 68 in FIG. 4) and the motors 41, 61 are coupled to gears 50, 70 via the motor casings 48, 68. Thus, the motors 41, 61 in this embodiment are of an outer-rotor motor arrangement (or an external-rotor motor arrangement), which means that the outside of the motor rotates and the center of the motor is stationary. In contrast, the motors 41' and 61' in the embodiment of FIG. 3 can have an internal-rotor motor arrangement in which the rotor is attached to the rotating central shaft.

Figure 4:
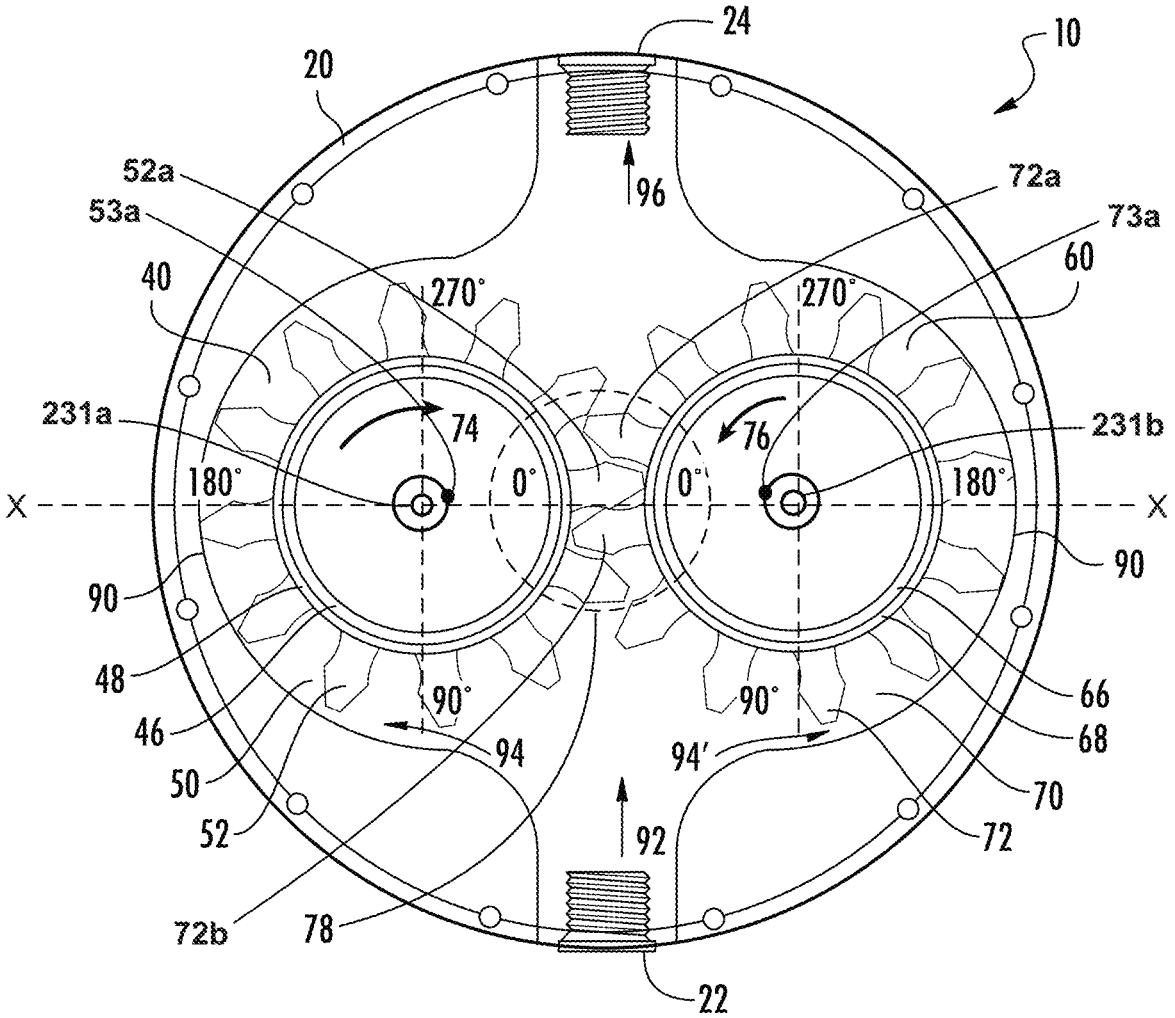
FIG. 4 shows a top cross-sectional view and an exemplary flow path for the external gear pump of FIG. 2.

FIG. 4 illustrates a top cross-sectional view of the external gear pump 10 and an exemplary fluid flow path (see flow arrows 92, 94, 94', 96) for the pump 10 based on the rotation of the gears 50, 70 (see rotation arrows 74 and 76, respectively). While the motors 41 and 61 are shown disposed in the interior volume 98, in some embodiments, one or both of the motors can be disposed external to the interior volume 98. Preferably, both gears 50, 70 are respectively independently driven by the separately provided motors 41, 61. In the embodiment of FIG. 4, the gear ratio is 1:1. However, the present disclosure is applicable to the control of pumps having gear ratios other than 1:1 and those skilled in the art will understand how to apply the inventive concepts of the present disclosure to the control of pumps having a variety of gear ratios.

Figure 5:
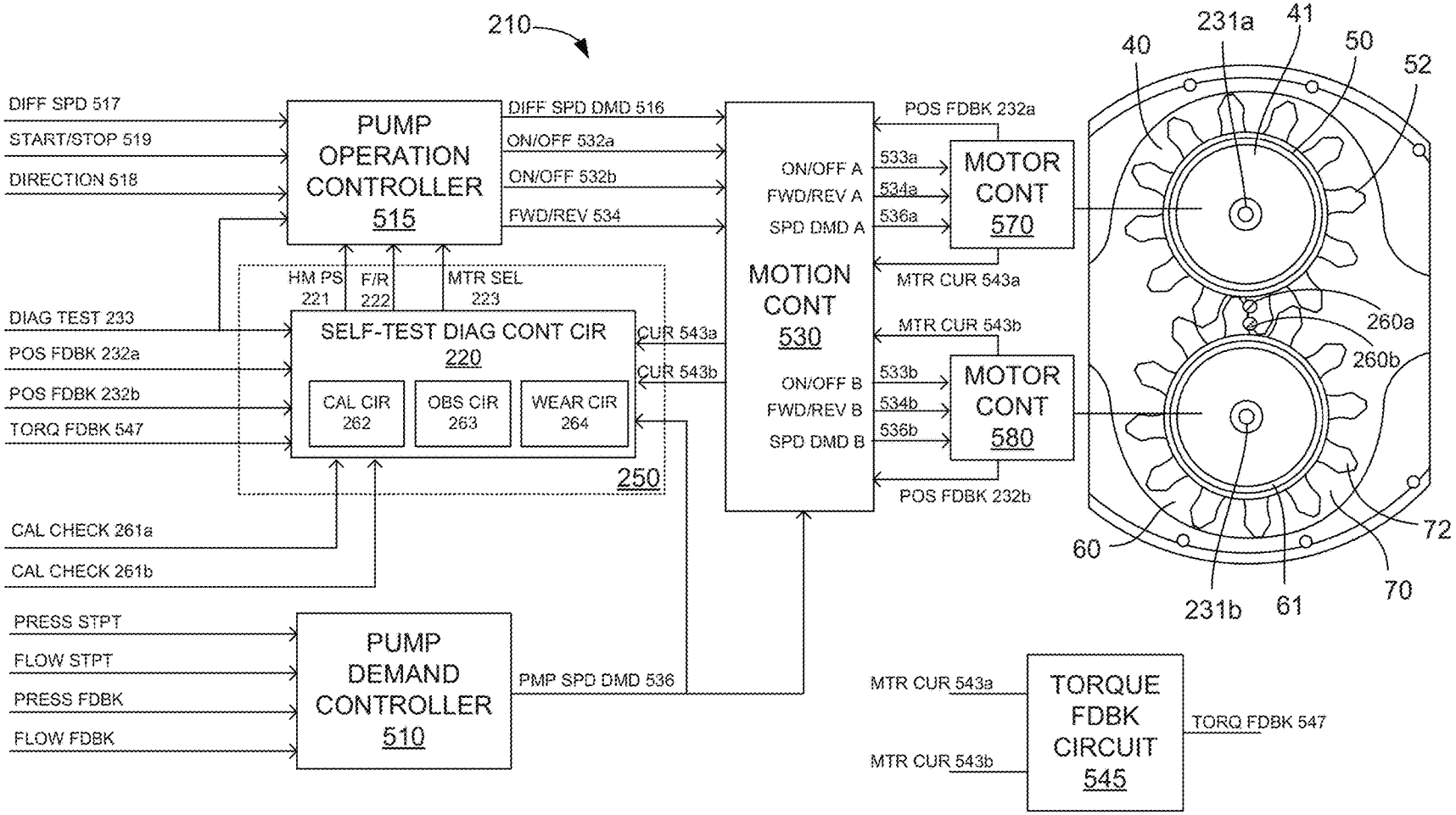
FIG. 5 is a schematic block diagram of a pump control system in accordance with an embodiment of the present disclosure.

Preferably, the pump control circuit 210 is configured to operate the pump in various modes of operation such as, for example, controlling the flow and/or pressure in the fluid system 25 to an appropriate operational setpoint (e.g., a flow setpoint and/or a pressure setpoint) or range. As seen in FIG. 5, the pump control circuit 210 can include a pump demand controller 510, a pump operation controller 515, a motion controller 530, a torque feedback circuit 545, and motor controllers 570, 580. The pump operation controller 515 can receive pump operation signals such as, for example, a pump start/stop signal 519, a differential speed signal 517, and/or a pump direction signal 518 from the supervisory control unit 250 and/or another controller, for example. In some embodiments, the pump operation controller 515 can also receive signals related to diagnostic checks such as a diagnostic test signal 233 and signals from the self-test circuit 220 (discussed further below). Based on the received signals, the pump operation controller 515 can output ON/OFF signals 532*a* and 532*b* to start or stop the respective motors 41, 61 and/or FWD/REV signal 534 to set the direction of rotation of the motors 41, 61. The signals 532*a,b*, and 534 can be sent to the motion controller 530, which then outputs individual ON/OFF signals 533*a*, 533*b* and FWD/REV signals 534*a*, 534*b* to the respective motor controllers 570 and 580, which operate motors 41, 61. In some embodiments, one or both signals 532*a,b* and/or FWD/REV signal 534 can be sent directly to the motor controllers 570, 580. A power supply (not shown) can supply the necessary power to motor controllers 570 and 580 so that the controllers 570 and 580 can output the required current to drive the respective motors 41, 61. The motor controllers 570, 580 can include the hardware such as inverters, IGBT switches, SCRs and associated controllers to output the required current to the motors 41, 61 based on individual speed demand signals 536*a*, 536*b*, respectively. Preferably, the motor controllers 570, 580 are variable-speed motor controllers. Variable-speed motor controllers are known to those skilled in the art and can be "off-the-shelf" products. Thus, for brevity, the configuration of the variable-speed motor controllers will not be further discussed.

In some embodiments, the individual speed demand signals 536*a*, 536*b* can be set based on a predetermined contact force (e.g., a predetermined or desired average contact force) between the gear teeth. For example, the pump operation controller 515 can output a differential speed demand signal 516 to the motion controller 530 that corresponds to a difference in the speed demand for each motor. Preferably, the differential speed demand signal 516 corresponds to the desired average contact force between the pairs of meshing gear teeth. The differential speed demand signal 516 can be based on the differential speed signal 517 and/or generated internally by the pump operation controller 515. During normal operation when, for example, the predetermined contact force between the teeth is desired (e.g., a period during which self-check diagnostics are not performed), the differential speed demand signal 516 can be output to motion controller 530, which can then use the differential speed demand signal 516 to adjust the individual speed demand signals 536*a*, 536*b* to the predetermined contact force.

In some embodiments, the pump demand controller 510 can provide a pump speed demand signal 536 to control the flow and/or pressure in the fluid system 25 based on, for example, a flow setpoint and/or pressure setpoint. The pump speed demand signal 536 can be used to set a base angular velocity for the gears 50, 70. The pump demand controller 510 can ensure that the flow and/or pressure is maintained at the respective flow and/or pressure setpoints during the various operating modes of the pump control system. An exemplary embodiment of the pump demand controller 510 can be found in U.S. application Ser. No. 15/756,928, which is incorporated herein in its entirety. However, the type of control scheme for generating a pump speed demand signal 536 is not limiting and exemplary embodiments of the present disclose can be directed to other types of control schemes that generate a pump speed demand signal for controlling flow and/or pressure in the fluid system (e.g., at the output of the pump 10). Preferably, the pump speed demand signal 536 can be output to the motion controller 530. Based on the pump demand signal 536 and the differential speed demand signal 516, the motion controller 530 generates and outputs the individual pump speed demand signals 536*a* and 536*b* to motor controllers 570 and 580, respectively.

Based on the ON/OFF signals 532*a,b*, the FWD/REV signal 534, the pump speed demand signal 536, and the differential speed demand signal 516, the motion controller 530 can output individual motor speed demand signals 536*a* and 536*b* and the individual FWD/REV signals 534*a* and 534*b* to motor controllers 570 and 580. The speed demand signals 536*a*, 536*b* set the appropriate angular velocity of the respective motors 41, 61 based on a desired flow and/or pressure, or more specifically, the speed demand signals 536*a*, 536*b* set the gear speed of the gears being driven based on a desired flow and/or pressure. As used herein, "gear speed" refers to the tip velocity of the gear tooth. Thus, the gear speed for each gear can be the same while the angular velocities can be different. For example, if the pump has a gear ratio of 2:1, the speed demand signal to the motor driving the smaller gear can be approximately twice the speed demand signal the larger gear, adjusting for the desired contact force. Of course, instead of the speed demand signals 536*a*, 536*b* taking into account the gear ratio of the pump 10, the motor controllers 570 and 580 can be configured to take into account the gear ratio by appropriately modifying the signals to the motors 41, 61. For clarity, speed demand signals 536*a* and 536*b*, as used herein, correspond to the gear speed. Thus, if speed demand signals 536*a* and 536*b* are equal, the tip speeds of the teeth 52, 72 are equal (even if the angular velocities of the gears may be different due to gear ratios other than 1:1).

In some systems, during operation of the pump, the pump control circuit 210 can maintain a difference in the speed demands to the individual motors 41, 61 based on the differential speed demand signal 516 to generate a desired average contact force on the gears 50,70. Preferably, the desired average contact force corresponds to a force that seals the backflow between the gears, for example. In some embodiments, the motion controller 530 can generate the speed demand signals for motors 41 and/or 61 based on the speed demand signal 536, and then, before outputting the signals as speed demand signals 536*a*, 536*b*, the motion controller 530 can modify one or both of the motor speed demand signals for the motors 41, 61 based on the differential speed demand signal 516. Preferably, the differential speed demand corresponds to the desired average contact force when the control system is in an operating mode that is not performing self-test diagnostics. Thus, based on the differential speed demand signal 516, the speed demand signals 536*a* and 536*b* to the motor controllers 570 and 580 can be set by the motion controller 530 such that one gear is attempted to be driven slightly faster than the other gear. However, because the gear teeth are in a meshing configuration, the gears will rotate at the same angular velocity (assuming a gear ratio of 1:1) and the difference in the speed demands to the respective motors produces a contact force between opposing gear teeth 52, 72. In some embodiments, the differential speed demand signal 516 is a fixed value that preferably relates to a predetermined contact force between pairs of meshing gear teeth. The fixed differential speed demand signal 516 can then be used by the motion controller 530 to adjust one or both of the speed demand signals 536*a* and 536*b* to generate a fixed average contact force between the meshing gear teeth 52, 72. Preferably, the fixed differential speed demand produces a contact force that is sufficient to seal the backflow or leakage of the fluid path from the outlet port to the inlet port of the pump 10 while keeping a corresponding torque between the meshing teeth pairs within an acceptable torque range for the pump motor and/or pump gears. For example, depending on the configuration of the pump, the fixed differential speed demand can correspond to a torque value in a range of about 1.0 Nm to 10 Nm and more preferably 1.0 Nm to 6 Nm. In some embodiments, for a gear ratio of 1:1, the differential speed demand can be controlled in a range of 0.0001 to 0.001 deg/sec, for example. In some embodiments, depending on the configuration of the pump 10, the differential speed demand can be controlled to produce a differential torque in a range between 1 Nm to 10 Nm, more preferably, in a range of 1 Nm to 6 Nm, and even more preferably, between 2 Nm and 4 Nm. In some embodiments, depending on the configuration of the pump 10, the differential speed demand can be controlled to provide an average differential torque that is about 3 Nm+0.1 Nm. Of course, the acceptable torque value and/or range can be different depending on, for example, the size and/or rating of the pump, size and/or configuration of the gears, size and/or configuration of the motors, and/or some other pump/gear/motor parameter. Accordingly, when not in self-test diagnostic mode (e.g., diagnostic test signal 233 is OFF (e.g., a low voltage value)), the differential speed demand signal 516 can be used to maintain a differential speed demand (e.g., a fixed value) on the motors 41, 61 during all normal operations of the pump 10 (e.g., as the pump demand signal 536 ramps the speed of the motors up and down).

However, in some embodiments, when the diagnostic test signal 233 is ON (e.g., a high voltage value), instead of being set to maintain a desired contact force, the differential speed demand signal 516 can be set according to one or more self-test diagnostic procedures. The self-test diagnostic procedures can include non-operational diagnostic procedures, which are performed prior to the start of normal operation and/or after shutdown of normal operation, and/or operational diagnostic procedures, which are performed during normal operation of the pump 10. The self-test circuit 220 can be configured to receive the position feedback signals from position sensors 231*a* and/or 231*b*. Preferably, the self-test circuit 220 can be configured such that, when performing the diagnostic procedures (discussed below), one or both of the gears 50, 70 can be precisely positioned relative to the other. To precisely control the gears 50, 70, in some embodiments, the rotational positions of the motors 41, 61 on the pump 10 are monitored, and the motors 41, 61 can be controlled to position one or both of the gears 50, 70 at a desired 360-degree rotation angle. That is, the position sensors 231*a* and 231*b* can be calibrated such that as the motors 41, 61 turn, the position sensors 231*a* and 231*b* provide feedback signals corresponding to a 360-position of the respective motor 41, 61. The position feedback signals can then be used by the motor controllers 570, 580 and/or the motion controller 530 to position the motors 41,61. Preferably, the motor controllers 570, 580 can be configured such that the 360-degree rotational position of each gear can be controlled to within +0.001 degree (e.g., controlled to an absolute position in comparison to a fixed reference point and/or to a relative position in comparison to the other gear).

In some embodiments, the position sensors 231*a* and 231*b* are calibrated to a reference point (e.g., a fixed reference point). For example, in some embodiments, a 0-degree position feedback reading on one or both motors 41, 61 (and thus the gears 50, 70) can correspond to a reference tooth on one or both gears 50, 70 being in the meshing region 78 along an axis X-X that is perpendicular to axis between the inlet port 22 and outlet port 24 (e.g., as shown in FIG. 4). Gear 50 and position sensor 231*a* can be configured such that the 0-degree reading on the position feedback signal corresponds to, for example, the reference tooth 52*a* being at the "3 o'clock" position as viewed from the top (FIG. 4 shows tooth 52*a* slightly above the 0-degree point). In addition, the position feedback signal for position sensor 231*a* can be configured to increase as the gear 50 is rotated clockwise until the reference tooth 52*a* is back at the "3 o'clock" position. For gear 70, position sensor 231*b* can be configured such that the 0-degree reading on the position feedback signal corresponds to, for example, the reference tooth 72*a* being at the "9 o'clock" position as viewed from the top (FIG. 4 shows tooth 72*a* slightly above the 0-degree point and above reference tooth 52*a*). The position feedback signal for position sensor 231*b* can be configured to increase as the gear 70 is rotated counter clockwise until the reference tooth 72*a* is back at the "9 o'clock" position. Of course, the position sensors 231*a* and 231*b* can be calibrated to another reference point or points so long as the feedback signals are properly scaled in the drive controllers. In addition, the readouts of the position sensor can be configured to increase in the counter-clockwise direction for both gears, increase in the clockwise direction for both gears, or increase in the clockwise direction for one gear and increase in the counter-clockwise direction for the other gear (e.g., as shown in FIG. 4).

The position sensors 231*a*, 231*b* can be installed so as to have a predetermined alignment to the respective reference tooth 52*a*, 72*a* for gears 50,70. To this end, in some embodiments, one or both gears can include an alignment device (e.g., a pin, notch, etc.) to align the position sensors 231*a*, 231*b* with the respective reference tooth and/or root area. For example, one or both of the 360-degree position feedback signals 232*a*, 232*b* can correspond to a crown of a reference tooth, a root area of a reference tooth, an edge (face) of a reference tooth, or some other reference point on the gear. For example, as seen in FIG. 4, alignment pin 53*a* can be used to ensure that the 360-degree position feedback signal 232*a* of gear 50 corresponds to the reference tooth 52*a* (e.g., to the center of the crown or to a root area adjacent tooth 52*a*) to within, for example, +0.001 degree. Similarly, the alignment pin 73*a* can be used to ensure that the 360-degree position feedback signal 232*b* of gear 70 corresponds to the reference tooth 72*a* (e.g., to the center of the crown or to a root area adjacent tooth 72*a*) to within, for example, +0.001 degree.

In some embodiments, the position sensors 231*a*, 231*b* can be, for example, encoders that are mounted on or coupled to the motor and/or the gear. The resolution of the encoders can depend on, among other things, the operating speed of the motors. If the resolution of the encoders is too low compared to the operating speed of the pump, then it is possible for the position feedback circuit to miss one or more pulses from the gear tooth being tracked. Thus, the position sensors 231*a*, 231*b* are preferably high-resolution encoders with a resolution that is high enough that position data is not lost. Preferably, the position sensor count (e.g., encoder count) is equal to or greater than 1.5 times the feedback count value corresponding to the fastest pump speed. In some embodiments, the position sensors 231*a*, 231*b* can have a count resolution in a range of 100,000 to four million per revolution, which can depend on the gear design and speed of the motor. Preferably, the encoders are configured to provide a 360-degree position feedback signal. In some embodiments, the position sensors 231*a*, 231*b* can be mounted on an appropriate location such as the gear shaft or the shaft of the motor driving the gear. For example, the position sensors 231*a*, 231*b* can be an integral part of the motor such as, e.g., a servomotor that allows for precise control of the angular velocity and position of the motor.

One or more controllers in the pump control circuit 210 (e.g., motion controller 530, self-test circuit 220, and/or the motor controllers 570, 580, and/or another controller) can be configured to determine the positions of one or more crowns and/or one or more roots of the gear teeth 52, 72 based on the feedback signals and known gear dimension information. In some embodiments, the pump control circuit 210 stores and/or otherwise has access to the gear dimensions. Using the gear dimensions and based on the position of the reference tooth 52*a*, 72*a*, one or more controllers in the pump control circuit 210 (e.g., motion controller 530, self-test circuit 220, and/or the motor controllers 570, 580, and/or another controller) can be configured such that the exact positions of one or more (or all) of the teeth 52, 72 can be determined (and not just the reference tooth 52*a*, 72*a*). The gear dimensions can be stored and/or otherwise accessible to the pump control circuit 210. In exemplary embodiments, the self-test circuit 220 (and/or another circuit in the pump control system 200) stores and/or has access to the original and/or previously determined dimensions of the gear 50, 70. For example, the geometrical shape and dimensions of each gear (including the tooth width, the root width, the nominal diameter of the gears, gap width between gear faces when one set of gear faces makes contact, etc.) can be stored in a database, e.g., in the form of lookup tables or other data structures, for access by the self-test circuit 220 (and/or another circuit). In some embodiments, the database can be stored externally and access to the database can be provided to the self-test circuit 220 (and/or another circuit) via, for example, a communication network. Because the gear dimensions are stored and/or can be otherwise accessed by the self-test circuit 220 (and/or another circuit), the self-test circuit 220 can determine, track, and/or store changes in the dimensions of the one or both gears 50, 70.

In some embodiments, the self-test circuit 220 can be configured to perform diagnostic check procedures that can be based on whether the pump 10 is in operation or not. That is, the self-test diagnostic procedures can be different based on whether the pump is running or stopped. For example, if the pump 10 is stopped, the self-test circuit 220 performs a preoperational and/or a post-operational diagnostic self-test procedure. If the pump 10 is running, the self-test circuit 220 performs an operational diagnostic check procedure. Preferably, the self-test circuit 220 can determine whether the pump 10 is running based on pump speed demand 536 and/or the position feedback signals 232*a*, 232*b*. For example, if pump speed demand 536 is at zero, the self-test circuit 220 performs a preoperational and/or post-operational diagnostic check procedure, and if the pump speed demand 536 is greater than zero, the self-test circuit 220 performs an operational diagnostic check procedure. The operational diagnostic checks on the drive-drive gear pump can include one or more procedures that check for wear on the gear teeth and/or obstructions that can hinder pump operation or efficiency. The preoperational and/or post-operational diagnostic checks can include one or more procedures that check for wear on the gear teeth, obstructions that can hinder pump operation or efficiency, and/or calibration drift or error in a position sensor (e.g., an encoder). The diagnostic check procedures can be performed automatically (e.g., periodically, based on running hours, and/or based on number of starts and/or stops) and/or can be initiated manually by the operator at any time.

In some embodiments, the self-test circuit 220 can use a home position as a reference position for one or more teeth 52,72 on one or both gears 50,70 when performing the diagnostic procedures. Preferably, the home position can correspond to the calibration reference points discussed above with respect to the calibration of the position sensors 231*a* and 231*b* (e.g., the 3 o'clock and 9 o'clock positions) and/or to another appropriate point. Of course, the reference points used for calibration purposes and the home positions used for self-test diagnostic checks need not be the same points and can be different in some embodiments. The home positions for the one or more teeth need not be the same and one or more teeth can each have a different home position. When performing operational diagnostics checks (discussed further below), the readings can be based on the teeth crossing their respective home positions. When performing preoperational and/or post-operational diagnostic checks, the reading can be based on the teeth being set at their respective home positions. As discussed above, in some embodiments, the home positions for each of the gears 50, 70 can be located in the meshing region 78 such as, for example the 3 o'clock or 0-degree position for reference gear tooth 52*a* and the 9 o'clock or 0-degree position for reference gear tooth 72*a*, as viewed from the top. Of course, the home position is not limited to the meshing regions 78 and can be located in other areas. For clarity, however, embodiments of the present disclosure are described with respect to reference teeth 52*a*, 72*a* and with their respective home positions corresponding to the 0-degree positions.

Figure 6:
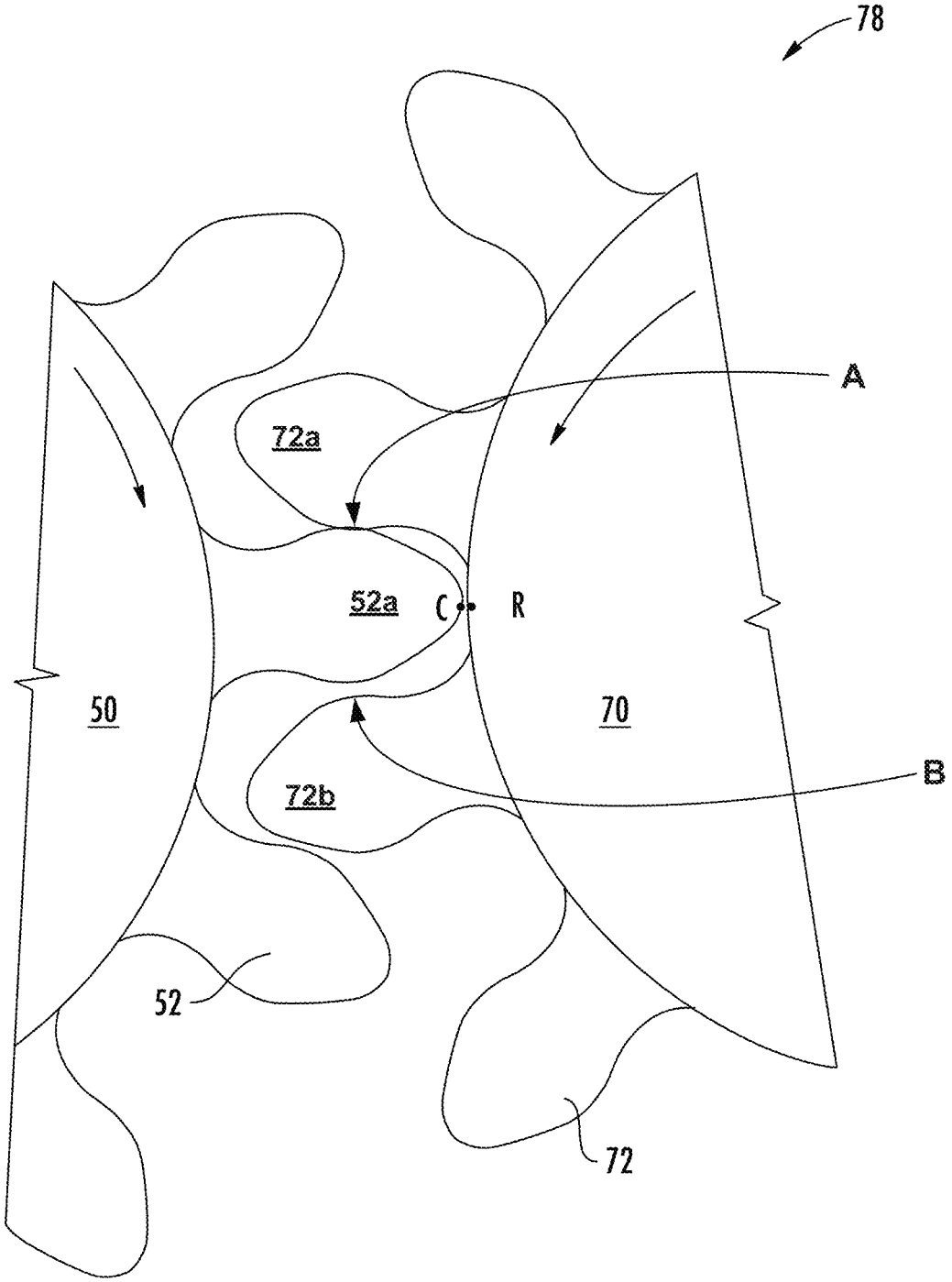
FIG. 6 is an enlarged view of the meshing area of the external gear pump of FIG. 2.

In some embodiments, the crown of the reference tooth 52*a*, 72*a* and/or a point on the root area adjacent the reference tooth 52*a*, 72*a* can be used as a guide for aligning the reference tooth 52*a*, 72*a* to the respective home positions. For example, as seen in FIG. 6, a point C on the crown the reference tooth 52*a* can be used to align reference tooth 52*a* to the home position for gear 50 and/or a point R on a root area adjacent the reference tooth 72*a* (e.g., between tooth 72*a* and 72*b*) can be used to align the reference tooth 72*a* to the home position for gear 70. In some embodiments, the respective home positions for gears 50 and 70 can be set at the same time. For example, the respective home positions for gears 50 and 70 can be set for when the reference teeth 52*a* and 72*a* are in contact with each other in the meshing region 78. Thus, in such embodiments, the calibration check for both position sensors 231*a* and 231*b* can be done concurrently. However, in other embodiments, the calibration checks for the position sensors 231*a* and 231*b* are done sequentially.

As discussed above, the self-test circuit 220 can perform diagnostic checks for calibration drift, obstructions of the gears 50, 70, and/or wear on the gears 50, 70. As seen in FIG. 5, the self-test circuit 220 receives a diagnostic test signal 233 (e.g., from supervisory control unit 250 and/or another controller), one or both position feedback signals 232*a*, 232*b* from the respective position sensors 231*a*, 231*b*, one or both calibration check signals 261*a*, 261*b* from respective calibration check sensors 260*a*, 260*b* and/or a torque feedback signal 547. In some embodiments, the torque feedback signal 547 can be a differential torque signal corresponding to a difference in the torques between the motors 41, 61. For example, the pump control circuit 210 can include a torque feedback circuit 545 that determines the difference in the torques of the two motors 41 and 61 using, for example, the respective motor currents 543*a* and 543*b*.

In some embodiments, as part of the self-test diagnostic procedure, the self-test circuit 220 (and/or another circuit) can include a calibration circuit 262 that checks the calibration of position sensors 231*a* and/or 231*b*. The calibration circuit 262 can receive calibration check feedback signals 261*a*, 261*b* (also referred to herein as calibration check signals 261*a*, 261*b*) from calibration check sensors 260*a* and 260*b*, respectively. The calibration check sensors 260*a,b* can be the same type of sensors as position sensors 231*a,b* (e.g., an encoder that provides a 360-degree position feedback signal) or a different type of sensor. For example, rather than a 360-type position sensor, the calibration check sensors 260*a,b* can be a spot or local sensor (e.g., magnetic, optical, laser, etc.) that checks for any deviation of the reference tooth 52*a*, 72*a* from the home position when the reference tooth 52*a*, 72*a* is driven to the home position. Preferably, the calibration check signals 261*a* and/or 261*b* can be used by the calibration circuit 262 to respectively check/verify the calibration of position sensors 231*a* and/or 231*b*. For example, to check the calibration of the position sensor 231*a*, self-test circuit 220 (and/or another circuit) can be configured to rotate one or both of the motors 41, 61 until the reference tooth 52*a* on gear 50 is in the home position based on the position feedback signals 232*a*. The self-test circuit 220 (and/or another circuit) can be configured to verify that any discrepancy between the feedbacks from position feedback signal 232*a* and the calibration check signal 261*a* is within a predetermined acceptable limit or limits used to determine whether a recalibration is needed and/or if there is a fault in the position sensors 231*a* and 231*b*. For example, when the reference tooth 52*a* for gear 50 is positioned at its home position (e.g., 0-deg. readout on the position feedback signal 232*a*), the calibration check signal 261*a* can be used to determine whether the reference tooth 52*a* is actually centered on the reference position corresponding its home position (e.g., 3 o'clock position). Based on a deviation from the received calibration check signal

261*a* and the expected home position signal from calibration check sensor 260*a*, an appropriate action is taken by the self-test circuit 220 and/or another controller. For example, if the deviation is less than or equal to a first predetermined value that corresponds to a proper calibration of position sensor 231*a*, the self-test circuit 220 and/or another controller can confirm that the calibration of position sensor 231*a* is good and that the drive system for gear 50 is ready for operation. If the deviation is above the first predetermined value but less than or equal to a second predetermined value, which corresponds to an error in the calibration of position feedback 231*a*, the self-test circuit 220 and/or another controller can alert the user of the calibration error and/or automatically recalibrate the position sensor 231*a* based on the deviation. A deviation above the second predetermined value can correspond to a fault in either the position sensor 231*a* and/or the calibration check sensor 260*a*. Preferably, an alarm is initiated by the control system and the pump is placed in a non-operational state until the deviation is resolved. The calibration of position sensor 231*b* can be similarly checked. The calibration checks of position sensors 231*a* and 231*b* can be performed sequentially or concurrently. Preferably, the pump control system 200 can include redundant sensors (e.g., for position sensors 231*a,b* and calibration check sensors 160*a,b*) for improved reliability. To verify a recalibration, the calibration circuit 262 can be configured to rotate the gears 50,70 a few times and, depending on the configuration, position one or both reference teeth 52*a*, 72*a* at the respective home positions. The calibration circuit 262 can then doublecheck whether there are discrepancies between the calibration check signals 261*a*, 261*b* and the respective position feedback signals 232*a* and 232*b*. If so, the recalibration can be performed again and/or an alert is issued.

In some embodiments, the self-test diagnostic can include a calibration check procedure that is to be performed with the pump 10 off. The pump control circuit 210 can be configured such that, with the pump start/stop signal 519 at STOP (e.g., a low voltage value) and the diagnostic test signal 233 is ON (e.g., a high voltage value), the pump operation controller 515 selects the signals that are output from the self-test circuit 220. The signals from the self-test circuit 220 preferably include a home position signal 221 and/or a motor select signal 223 to control the motors 41,61. The motor select signal 223 selects which gear to rotate to the home position for the diagnostic check. The home position signal 221 can provide a command to, for example, pump operation controller 515 (and/or another controller) to move the selected gear to the home position as discussed above. Based on the home position signal 221 and/or a motor select signal 223, the pump operation controller 515 appropriately outputs the motor on/off signals 532*a* and 532*b* and the FWD/REV signal 534 to the motion controller 530, which then outputs the individual signals to the respective motor controllers 570, 580. Preferably, based on the home position signal 221 and/or the motor select signal 223 (via the pump operation controller 515 and/or the motion controller 530), the motor controllers 570, 580 control a 360-degree rotational position of the respective gears 50, 70 to within 3.6 seconds of arc. Preferably, the position of the gears 50, 70 can be determined to, e.g., within +/−0.0010° or to within +/−0.0065°. In some embodiments, the position sensors 231*a*, 231*b* can measure an angular position of one or more teeth 52, 72 on gears 50, 70, respectively, to within a range of, e.g., +/−0.0010° to +/−0.0065°.

When the reference tooth 52*a*, 72*a* is being set to the home position, in some embodiments, the motors 41, 61 (and thus the respective gears 50, 70) can be rotated at a predetermined angular velocity. Preferably, the position sensors 231*a*, 231*b* (and/or another sensor) can measure and/or calculate the angular velocity of the shaft of the motor/gear. In some embodiments, when controlling the angular velocity of the gears 50, 70, the respective motor controllers 570, 580 can control the angular velocity to within an accuracy of +0.001 rpm. Preferably, the predetermined angular velocity is set so that the gears 50, 70 do not overshoot when moving to the respective home positions. In some embodiments, the motion controller 530 (and/or another controller) can adjust the motor angular velocity and thus the gear angular velocity in increments of +0.001 radians/sec via, for example, speed demand signals 536*a* and/or 536*b*. Preferably, the predetermined angular velocity value is fixed value. However, in other embodiments, the predetermined angular velocity value can vary based on, for example, distance from the home position (and/or some other criteria). The motion controller 530 can internally generate the predetermined angular velocity and/or receive an external signal corresponding to the predetermined angular velocity (e.g., the differential speed demand signal 516 can correspond to the angular velocity when in the preoperational and/or post-operational diagnostic mode). The predetermined angular velocity can then be output as the individual speed demand signals 536*a* and 536*b*. When the appropriate gear 50, 70 is at the home position, the individual speed demand signals 536*a* and 536*b* can be set to zero. When the reference tooth 52*a* and/or 72*a* is at the home position, the calibration check sensors 260*a* and 260*b* can check whether there is a discrepancy as discussed above.

In some embodiments, the self-test circuit 220 (and/or another controller) includes an obstruction check circuit 263 that monitors for potential problems that can affect operation of the pump and/or could potentially damage the pump. Preferably, the obstruction check circuit 263 verifies that the pump 10 does not have obstructions and/or contamination that can affect operation. The obstruction check can be performed prior to, during, and/or after normal operation of the pump. In some embodiments, the obstruction check is performed as part of the preoperational and/or post-operational checks (e.g., after the calibration check). The pump 10 can be operated at a predetermined speed (e.g., a constant speed or a variable speed) for which certain feedback parameters (e.g., gear position and/or motor currents) are known (expected feedback values). Preferably, during the operation of the pump 10, a check is performed for obstructions and/or contaminates that deviate from and/or could affect normal pump operation. For example, as the gears 50, 70 are rotated, the obstruction check circuit 263 can monitor the motor currents 543*a*, 543*b*, and/or position feedback signals 232*a*, 232*b* (and/or some other feedback) to check that the velocity and/or acceleration of the gears 50, 70 and/or the current, voltage and/or power of one or both of the drive motors 41, 61 are within acceptable limits for the operating speed(s) of the gears. If not, preferably the obstruction check circuit 263 alerts the operator that a condition exists that could affect proper operation of the pump 10 and/or has the potential to damage the pump 10.

In some embodiments, the self-test circuit 220 (and/or another controller) includes a wear check circuit 264 that monitors for wear of the gear teeth. Preferably, the wear check circuit 264 can precisely control the position of one or both of the gears 50,70 (e.g., using motors 41, 61 via respective motor controllers 570, 580) to check for wear in one or more of the gear teeth 52,72. Preferably, the wear check circuit 264 can determine a current tooth width of one or more gear teeth and/or a current root width between faces of one or more opposing gear teeth pair. In some embodiments, the wear checks are performed after the calibrations have been verified. Preferably, the self-test circuit 220, including the wear check circuit 264, includes and/or has access to a database that stores the structural data (e.g., dimensions) of the gears 50 and 70. In some embodiments, based on the motor select signal 223 from the self-test circuit 220, the pump operation controller 515 selects the operation of either the motor 41 or motor 61 in order to check for wear on the gear teeth 52, 72. For example, if motor 41 is selected for operation, then motor 61 (and the corresponding gear 70) is locked in place by the pump operation controller 515 (e.g., via motion controller 530 and/or motor controller 580). With gear 70 locked in place, based on a forward/reverse signal 222 from the self-test circuit 220 (and/or an initial default direction in pump operation controller 515), the pump operation controller 515 moves gear 50 (e.g., via motion controller 530 and/or motor controller 570) until a tooth 52 on gear 50 contacts a tooth 72 on gear 70. For example, as seen in the FIG. 6, gear 50 can be moved until tooth 52*a* makes contact with tooth 72*a* of gear 70 at point A with a contact force that is in a range of, e.g., 5 to 10 N*m, as indicated by the torque feedback signal 547, for example. The contact force is an indication that the gears 50, 70 have made positive contact. The wear check circuit 264 (and/or another circuit) then records the position of gear 50 based on the position feedback signal 232*a*. Once the position reading is taken, based on the forward/reverse signal 222 (and/or a default reverse direction in pump operation controller 515), while still keeping gear 70 locked, the pump operation controller 515 then moves gear 50 in the opposite direction until tooth 52*a* makes contact with tooth 72*b* of gear 70 at point B with contact force that is in a range of, e.g., 5 to 10 N*m, as indicated by the torque feedback signal 547, for example. The control system then records the new position of gear 50 as read by position feedback signal 232*a*.

In some embodiments, wear check circuit 264 (and/or another control circuit) is configured to subtract the two position values (e.g., the position values of gear tooth 52*a* taken when at points A and B) to determine the absolute value of the change in the position angle readout. By using the change in the position angle readout, the self-test circuit 220 (and/or another control circuit) can determine the current gap width in the root area between teeth 72*a* and 72*b* of gear 70 when tooth 52*a* of gear 50 meshes with teeth 72*a* and 72*b*. The calculation of the wear, wear rate, gap width, and/or tooth width based on known gear dimensions and the position angle readout is within the capabilities of those skilled in the art and thus will not be discussed in detail. Preferably, the wear check circuit 264 (and/or another control circuit) compares the gap width that has just been calculated with one or more reference gap width values to determine the wear in the gear teeth and/or a rate of change in the wear of the gear teeth. For example, the wear check circuit 264 (and/or another control circuit) can check the current gap width with the previously calculated gap width and/or the original "as new" gap width based on the original gear tooth dimensions, which can then be used to calculate the wear and/or the rate of wear of gear tooth 52*a*. The wear and/or wear rate can be used to schedule the next maintenance inspection and/or replacement of the gears. In some embodiments, if the current gap width value exceeds an acceptable wear limit, preferably the self-test circuit 220 (and/or another control circuit) provides an alarm to the operator and/or the pump control circuit 210 can be set to a non-operational state. Based on the wear and/or the wear rate of the gear teeth 52,72, the self-test circuit 220 (and/or another control circuit) can notify the user of potential problems due to wear in the gear teeth (e.g., inefficient and/or erratic operation), predict and/or schedule when the gear pump should be inspected, and/or determine if fluid is contaminated with foreign particles and/or if there are mechanical issues with the pump (alignment, bearings, etc.). Because the wear patterns on gear teeth are generally the same, in some embodiments, only one reference tooth (e.g., reference tooth 52*a* on gear 50) can be checked against corresponding reference teeth (e.g., reference teeth 72*a* and 72*b* on gear 70). However, because variations in the differential torque values can exist, which can lead to variations in wear patters, in some embodiments, the wear checks can be performed on a tooth-by-tooth basis for more than one tooth (e.g. all the teeth). In some embodiments, after the checks on one or more (e.g., all) gear teeth 52, the gear 50 is held stationary and wear checks are performed on one or more (e.g., all) gear teeth 72. In the above embodiments, the diagnostic checks are described as being performed before normal operation of the pump 10. However, in other embodiments, the diagnostic checks can be performed after normal operation of the pump 10 or both before and after.

In the above embodiment, the diagnostic checks were done prior to and/or after normal operation. However, in some embodiments, the wear check of one or more gear teeth 52, 72 can be performed during normal operation of the pump 10. In some embodiments, when the diagnostic test signal 233 is ON (e.g., a high voltage value) and the pump 10 is running (e.g., as determined by the pump speed demand 536 being greater than zero), the pump operation controller 515 can use the forward/reverse signal 222 from the self-test circuit 210 to vary the differential speed demand signal 516 to change the gear contact of tooth 52*a* between points A and B (see FIG. 6) while the pump 10 is in operation. As discussed above, the differential speed demand signal 516 sets one of the individual speed demand signals 536*a* or 536*b* slightly different than the other to create contact between the gears 50, 70. For example, during normal operation, the meshing gear teeth pairs may make contact at point A of the respective gear teeth pairs. However, when diagnostic test signal 233 is ON (e.g., a high voltage value), the differential speed demand signal 516 can change such that the contact point for the meshing gear teeth pairs changes from point A to point B of the respective gear teeth pairs. A set of readings can be taken on one or more gear teeth to determine the respective gear tooth widths, root widths, tooth wear, and or wear rate in a manner similar to as discussed above. For example, during the time the diagnostic test signal 233 is ON (e.g., a high voltage value) with the pump 10 operating, gear teeth 52*a* and 72*a* can be in contact at point A as the gears rotate. As point R corresponding to root area between gear tooth 72*a* and 72*b* passes the home position (e.g., point R at the 0-degrees on position feedback signal 232*b*), the self-test circuit 220 can be configured to read the position feedback signal 232*a* for gear tooth 52*a* when making contact at point A. Then, forward/reverse signal 222 from the self-test circuit 210 can be adjusted to vary the differential speed demand signal 516 so that the gear contact of tooth 52*a* is at point B. As point R corresponding to root area between gear tooth 72*a* and 72*b* passes the home position again (e.g., point R at the 0-degrees on position feedback signal 232*b*), the self-test circuit 220 can be configured to read the position feedback signal 232*a* for gear tooth 52*a* when making contact at point B. Preferably, the set of readings can be correlated so as to determine the current root width and/or the tooth width, which can then be compared to previous readings and/or the original gear dimensions to determine the gear wear and/or wear rate. Based on the gear wear and/or wear rate, the appropriate actions can be taken as discussed above. Although gear tooth 52*a* is discussed above, similar readings can be taken for one or more of the other gear teeth (or all) in other embodiments.

All or a portion of the pump control system 200, including supervisory control unit 250, pump control circuit 210, self-test circuit 220 and/or any other component of controller can be implemented in, e.g., hardware and/or algorithms and/or programming code executable by a processor. The pump control system 200, including the pump control circuit 210, can be used in applications that include hydraulics, aeronautics, automotive, industrial systems, medical systems, agriculture, or any other application that require a pump. The supervisory control unit 250 can be configured as appropriate depending on the type of application and, depending on whether the application requires user input, supervisory control unit 250 can be configured to receive inputs from an operator input unit 270. Operator input unit 270 can be, e.g., a control panel that can include user interfaces to allow the operator to communicate with the control unit 250. For example, the control panel can include digital and/or analog displays such as, e.g., LEDs, liquid crystal displays, CRTs, touchscreens, meters, and/or another type of display which communicate information to the operator via a textual and/or graphical user interface (GUI), indicators (e.g., on/off LEDs, bulbs) and any combination thereof; and digital and/or analog input devices such as, e.g., touchscreens, pushbuttons, dials, knobs, levers, joysticks and/or other similar input devices; a computer terminal or console with a keyboard, keypad, mouse, trackball, touchscreen or other similar input devices; a portable computing device such as a laptop, personal digital assistant (PDA), cell phone, digital tablet or some other portable device; or a combination thereof.

The pump control system 200 can be provided to exclusively control fluid system 25. Alternatively, the supervisory control unit 250 can be part of and/or used in cooperation with another control system for a system, machine or another application in which the pump 10 operates. The pump control system 200 (e.g., supervisory control unit 250) can include a central processing unit (CPU) which performs various processes such as commanded operations or pre-programmed routines, algorithms, instructions, and/or other program code. The process data and/or routines can be stored in a memory. The routines can also be stored on a storage medium disk such as a hard drive (HDD) or portable storage medium or can be stored remotely. However, the storage media is not limited by the media listed above. For example, the routines can be stored on CDs, DVDs, in FLASH memory, RAM, ROM, PROM, EPROM, EEPROM, hard disk or any other information processing device with which the computer aided design station communicates, such as a server or computer.

The CPU can be a Xenon or Core processor from Intel of America or an Opteron processor from AMD of America, or can be other processor types that would be recognized by one of ordinary skill in the art. Alternatively, the CPU can be implemented on an FPGA, ASIC, PLD or using discrete logic circuits, as one of ordinary skill in the art would recognize. Further, the CPU can be implemented as multiple processors cooperatively working in parallel to perform commanded operations or pre-programmed routines.

The pump control system 200, e.g., supervisory control unit 250, can include a network controller, such as an Intel Ethernet PRO network interface card from Intel Corporation of America, for interfacing with a network. As can be appreciated, the network can be a public network, such as the Internet, or a private network such as a LAN or WAN network, or any combination thereof and can also include PSTN or ISDN sub-networks. The network can also be wired, such as an Ethernet network, or can be wireless, such as a cellular network including EDGE, 3G, and 4G wireless cellular systems. The wireless network can also be WiFi, Bluetooth, or any other wireless form of communication that is known. The pump control system 200, e.g., supervisory control unit 250 can receive a command from an operator via a user input device such as a keyboard and/or mouse via either a wired or wireless communication. In addition, the communications between supervisory control unit 250, the motor controllers 570, 580, and/or other controllers can be analog or via digital bus and can use known protocols such as, e.g., controller area network (CAN), Ethernet, common industrial protocol (CIP), Modbus and other well-known protocols.

Embodiments of the controllers and/or modules in the present disclosure can be provided as a hardwire circuit and/or as a computer program product. As a computer program product, the product may include a machine-readable medium having stored thereon instructions, which may be used to program a computer (or other electronic devices) to perform a process. The machine-readable medium may include, but is not limited to, floppy diskettes, optical disks, compact disc read-only memories (CD-ROMs), and magneto-optical disks, ROMs, random access memories (RAMs), erasable programmable read-only memories (EPROMs), electrically erasable programmable read-only memories (EEPROMs), field programmable gate arrays (FPGAs), application-specific integrated circuits (ASICs), vehicle identity modules (VIMs), magnetic or optical cards, flash memory, or other type of media/machine-readable medium suitable for storing electronic instructions.

The term "module" refers broadly to a software, hardware, or firmware (or any combination thereof) component. Modules are typically functional components that can generate useful data or other output using specified input(s). A module may or may not be self-contained. The controllers discussed above may include one or more modules.

Although the above drive-drive embodiments were described with respect to an external gear pump arrangement with spur gears having gear teeth, it should be understood that those skilled in the art will readily recognize that the concepts, functions, and features described below can be readily adapted to external gear pumps with other gear configurations (helical gears, herringbone gears, or other gear teeth configurations that can be adapted to drive fluid), internal gear pumps with various gear configurations, to pumps having more than two prime movers, to prime movers other than electric motors, e.g., hydraulic motors or other fluid-driven motors, inter-combustion, gas or other type of engines or other similar devices that can drive a fluid displacement member, and to fluid displacement members other than an external gear with gear teeth, e.g., internal gear with gear teeth, a hub (e.g. a disk, cylinder, other similar component) with projections (e.g. bumps, extensions, bulges, protrusions, other similar structures or combinations thereof), a hub (e.g. a disk, cylinder, or other similar component) with indents (e.g., cavities, depressions, voids or other similar structures), a gear body with lobes, or other similar structures that can displace fluid when driven. Accordingly, for brevity, detailed description of the various pump configurations is omitted. In addition, those skilled in the art will recognize that, depending on the type of pump, the contact (drive-drive) can aid in the pumping of the fluid instead of or in addition to sealing a reverse flow path. For example, in certain internal-gear gerotor configurations, the contact or meshing between the two fluid displacement members also aids in pumping the fluid, which is trapped between teeth of opposing gears. Further, while the above embodiments have fluid displacement members with an external gear configuration, those skilled in the art will recognize that, depending on the type of fluid displacement member, the contact or meshing is not limited to a side-face to side-face contact and can be between any surface of at least one projection (e.g. bump, extension, bulge, protrusion, other similar structure, or combinations thereof) on one fluid displacement member and any surface of at least one projection (e.g. bump, extension, bulge, protrusion, other similar structure, or combinations thereof) or indent (e.g., cavity, depression, void or other similar structure) on another fluid displacement member.

The fluid displacement members, e.g., gears in the above embodiments, can be made entirely of any one of a metallic material or a non-metallic material. Metallic material can include, but is not limited to, steel, stainless steel, anodized aluminum, aluminum, titanium, magnesium, brass, and their respective alloys. Non-metallic material can include, but is not limited to, ceramic, plastic, composite, carbon fiber, and nano-composite material. Metallic material can be used for a pump that requires robustness to endure high pressure, for example. However, for a pump to be used in a low pressure application, non-metallic material can be used. In some embodiments, the fluid displacement members can be made of a resilient material, e.g., rubber, elastomeric material, to, for example, further enhance the sealing area.

Alternatively, the fluid displacement member, e.g., gears in the above embodiments, can be made of a combination of different materials. For example, the body can be made of aluminum and the portion that makes contact with another fluid displacement member, e.g., gear teeth in the above exemplary embodiments, can be made of steel for a pump that requires robustness to endure high pressure, a plastic for a pump for a low pressure application, a elastomeric material, or another appropriate material based on the type of application.

Exemplary embodiments of the fluid delivery system can displace a variety of fluids. For example, the pumps can be configured to pump hydraulic fluid, engine oil, crude oil, blood, liquid medicine (syrup), paints, inks, resins, adhesives, molten thermoplastics, bitumen, pitch, molasses, molten chocolate, water, acetone, benzene, methanol, or another fluid. As seen by the type of fluid that can be pumped, exemplary embodiments of the pump can be used in a variety of applications such as heavy and industrial machines, aeronautics applications, automobile applications, chemical industry, food industry, medical industry, commercial applications, residential applications, or another industry that uses pumps. Factors such as fluid density, viscosity temperature of the fluid, desired pressures and flow for the application, the configuration of the fluid displacement member, the size and power of the motors, physical space considerations, weight of the pump, or other factors that affect pump configuration will play a role in the pump arrangement. It is contemplated that, depending on the type of application, the exemplary embodiments of the fluid delivery system discussed above can have operating ranges that fall with a general range of, e.g., 1 to 5000 rpm. However, in aerodynamic applications, the pump can have operating ranges that are 6000 to 12,000 rpm or greater. Of course, these ranges are not limiting and other ranges are possible.

In addition, the dimensions of the fluid displacement members can vary depending on the application of the pump. For example, when gears are used as the fluid displacement members, the circular pitch of the gears can range from less than 1 mm (e.g., a nano-composite material of nylon) to a few meters wide in industrial applications. The thickness of the gears will depend on the desired pressures and flows for the application.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

The invention claimed is:

1. A pump control system, comprising:

a pump control circuit configured to operate a first motor to rotate a first gear of a pump and a second motor to rotate a second gear of the pump, the pump control circuit including a sensor for that determines a position and/or a velocity of the first gear; and a diagnostic circuit connected to the pump control circuit, the diagnostic circuit configured to perform a diagnostic check to determine at least one of a gear wear parameter or an obstruction in the pump, based on the position and/or velocity determined by the sensor.

2. The pump control system of claim 1, wherein the diagnostic circuit is configured to perform the following:

control the pump control circuit to position a first tooth on the first gear so as to contact a second tooth on the second gear at a first point, read first position information of the first tooth from the sensor with the first tooth contacting the first point, control the pump control circuit to position the first tooth on the first gear so as to contact a third tooth on the second gear at a second point, read second position information of the first tooth from the sensor with the first tooth contacting the second point, and determine, based on the first and second position information, the gear wear parameter, wherein the gear wear parameter includes at least one of a tooth width of the first tooth, root width between the second tooth and third tooth, wear of the first tooth, or a wear rate of the first tooth.

3. The pump control system of claim 1, wherein the diagnostic circuit is configured to initiate the diagnostic check during normal operation of the pump.

4. The pump control system of claim 1, wherein the diagnostic circuit is configured to initiate the diagnostic check during at least one of a preoperational check on the pump or a post-operational check on the pump.

5. The pump control system of claim 4, wherein the diagnostic circuit further controls the pump control circuit to lock the second motor in place during the diagnostic check.

6. The pump control system of claim 1, wherein the pump control circuit includes a second sensor for determining a second position and/or second velocity of the first gear, wherein the diagnostic circuit is configured to perform a calibration drift check that includes:

reading first position information of the first gear from the sensor when a first tooth is at a first reference point, reading second position information of the first gear from the second sensor when the first tooth is at the first reference point, and determining the calibration drift based on a difference between the first and second position information, and wherein, based on the calibration drift, the diagnostic circuit determines at least one of whether a recalibration is needed or whether a sensor fault exists on the sensor or the second sensor.

7. The pump control system of claim 1, wherein the diagnostic circuit is configured to perform the following:

operate the pump at a predetermined speed based on the sensor, monitor feedback that includes at least one of a gear feedback or a motor feedback, compare the monitored feedback to an expected feedback value for the predetermined speed, determine, based on the comparison, whether there is an obstruction and/or contaminate in the pump based on a deviation between the monitored feedback and the expected feedback value.

8. The pump control system of claim 7, wherein the motor feedback includes at least one of a current, voltage, or power of at least one of the first motor or the second motor, and wherein the determination of the obstruction and/or contaminate includes a check of whether the motor feedback is within predetermined limits.

9. The pump control system of claim 7, wherein the gear feedback includes at least one of a velocity and/or an acceleration of the first and second gears, and wherein the determination of the obstruction and/or contaminate includes a check of whether the gear feedback is within predetermined limits.

10. A pumping system, comprising:

a pump assembly having a first motor driving a first gear and a second motor driving a second gear;

a fluid system connected to the pump assembly; and a pump control system, wherein the pump control system includes, a pump control circuit configured for operating the first motor to rotate the first gear of a pump and the second motor to rotate the second gear of the pump, the pump control circuit including a sensor for determining a position and/or a velocity of the first gear, and a diagnostic circuit connected to the pump control circuit, the diagnostic circuit configured to perform a diagnostic check to determine at least one of a gear wear parameter or an obstruction in the pump, based on the position and/or velocity determined by the sensor.

11. The pumping system of claim 10, wherein the first and second motors are disposed inside respective openings in the first and second gears.

12. A method of performing a diagnostic check on a pump, the method comprising:

operating a first motor to rotate a first gear of a pump;

operating a second motor to rotate a second gear of the pump;

determining a position and/or a velocity of the first gear by a sensor;

performing a diagnostic check to determine at least one of a gear wear parameter or an obstruction in the pump based on the position and/or velocity determined by the sensor.

13. The method of claim 12, wherein the performing of the diagnostic check includes:

controlling a position of a first tooth on a first gear of the pump so as to contact a second tooth on a second gear of the pump at a first point;

reading, using the sensor, first position information of the first tooth with the first tooth contacting the first point;

controlling the position of the first tooth so as to contact a third tooth on the second gear at a second point;

reading, using the sensor, second position information of the first tooth with the first tooth contacting the second point; and determining, based on the first and second position information, the gear wear parameter, wherein the gear wear parameter includes at least one of a tooth width of the first tooth, root width between the second tooth and third tooth, wear of the first tooth, or a wear rate of the first tooth.

14. The method of claim 12, wherein the performing of the diagnostic check is initiated during normal operation of the pump.

15. The method of claim 12, wherein the performing of the diagnostic check is initiated during at least one of a preoperational check on the pump or a post-operational check on the pump.

16. The method of claim 15, wherein the second motor is locked in place during the diagnostic check.

17. A method comprising:

operating a first motor to rotate a first gear of a pump;

operating a second motor to rotate a second gear of the pump;

determining a position and/or a velocity of the first gear by a sensor;

performing a diagnostic check to determine at least one of a gear wear parameter based on the sensor, a calibration drift of the sensor, or an obstruction in the pump using the sensor;

determining a second position and/or a second velocity of the first gear using a second sensor;

reading first position information of the first gear from the sensor when a first tooth is at a first reference point;

reading second position information of the first gear from the second sensor when the first tooth is at the first reference point;

determining the calibration drift based on a difference between the first and second position information; and determining, based on the calibration drift, at least one of whether a recalibration is needed or whether a sensor fault exists on the first sensor or the second sensor.

18. A method comprising:

operating a first motor to rotate a first gear of a pump;

operating a second motor to rotate a second gear of the pump;

determining a position and/or a velocity of the first gear by a sensor;

performing a diagnostic check to determine at least one of a gear wear parameter based on the sensor, a calibration drift of the sensor, or an obstruction in the pump using the sensor;

operating the pump at a predetermined speed based on the sensor;

monitoring feedback that includes at least one of a gear feedback or a motor feedback;

comparing the monitored feedback to an expected feedback value for the predetermined speed; and determining, based on the comparison, whether there in an obstruction and/or contaminate in the pump based on a deviation between the monitored feedback and the expected feedback value.

19. The method of claim 18, wherein the motor feedback includes at least one of a current, voltage, or power of at least one of the first motor or the second motor, and wherein the determination of the obstruction and/or contaminate includes a check of whether the motor feedback is within predetermined limits.

20. The method of claim 18, wherein the gear feedback includes at least one of a velocity and/or an acceleration of the first and second gears, and wherein the determination of the obstruction and/or contaminate includes a check of whether the gear feedback is within predetermined limits.

* * * * *